United States Patent [19]

Wolff et al.

[11] Patent Number: 4,581,324

[45] Date of Patent: Apr. 8, 1986

[54] COLOR PHOTOGRAPHIC RECORDING MATERIAL FOR THE PRODUCTION OF COLOR IMAGES VIEWED BY REFLECTED LIGHT

[75] Inventors: Erich Wolff, Solingen; Günter Renner, Bergisch Gladbach; Friedrich-Wilhelm Kunitz, Leverkusen, all of Fed. Rep. of Germany

[73] Assignee: Agfa-Gevaert Aktiengesellschaft, Leverkusen, Fed. Rep. of Germany

[21] Appl. No.: 666,265

[22] Filed: Oct. 29, 1984

[30] Foreign Application Priority Data

Nov. 8, 1983 [DE] Fed. Rep. of Germany ..... 3340270

[51] Int. Cl.[4] ..... G03C 1/46

[52] U.S. Cl. ..... 430/505; 430/551; 430/553; 430/555; 430/557; 430/558

[58] Field of Search ..... 430/505, 552, 553, 554, 430/555, 557, 558, 551

[56] References Cited

U.S. PATENT DOCUMENTS

| | | | |
|---|---|---|---|
| 3,772,002 | 11/1973 | Ramello | 430/552 |
| 4,454,225 | 6/1984 | Sakai et al. | 430/505 |
| 4,455,367 | 6/1984 | Seoka et al. | 430/553 |
| 4,456,681 | 6/1984 | Kadowaki et al. | 430/505 |

*Primary Examiner*—J. Travis Brown

*Attorney, Agent, or Firm*—Connolly and Hutz

[57] ABSTRACT

Colored, reflection-viewed images having improved stability to light, heat and moisture and improved storage stability while retaining the original color character thereof are produced using color photographic recording materials containing, on a light-reflecting layer support, a red-sensitive, a green-sensitive and a blue-sensitive silver halide emulsion layer, each with spectrally associated color coupler, the yellow coupler being a 2-equivalent yellow coupler derived from pivaloyl acetanilide, the magenta coupler a 3-anilinopyrazolone coupler and the cyan coupler a coupler corresponding to the following general formula (I);

(I)

wherein $R^1$ represents H or halogen;

$R^2$ represents alkyl having at least 2 carbon atoms;

$R^3$ represents H or alkyl having up to 5 carbon atoms;

$R^4$ represents acyl; and $X^1$ represents H or a group releasable in the process of color coupling.

5 Claims, 1 Drawing Figure

Figure 1:
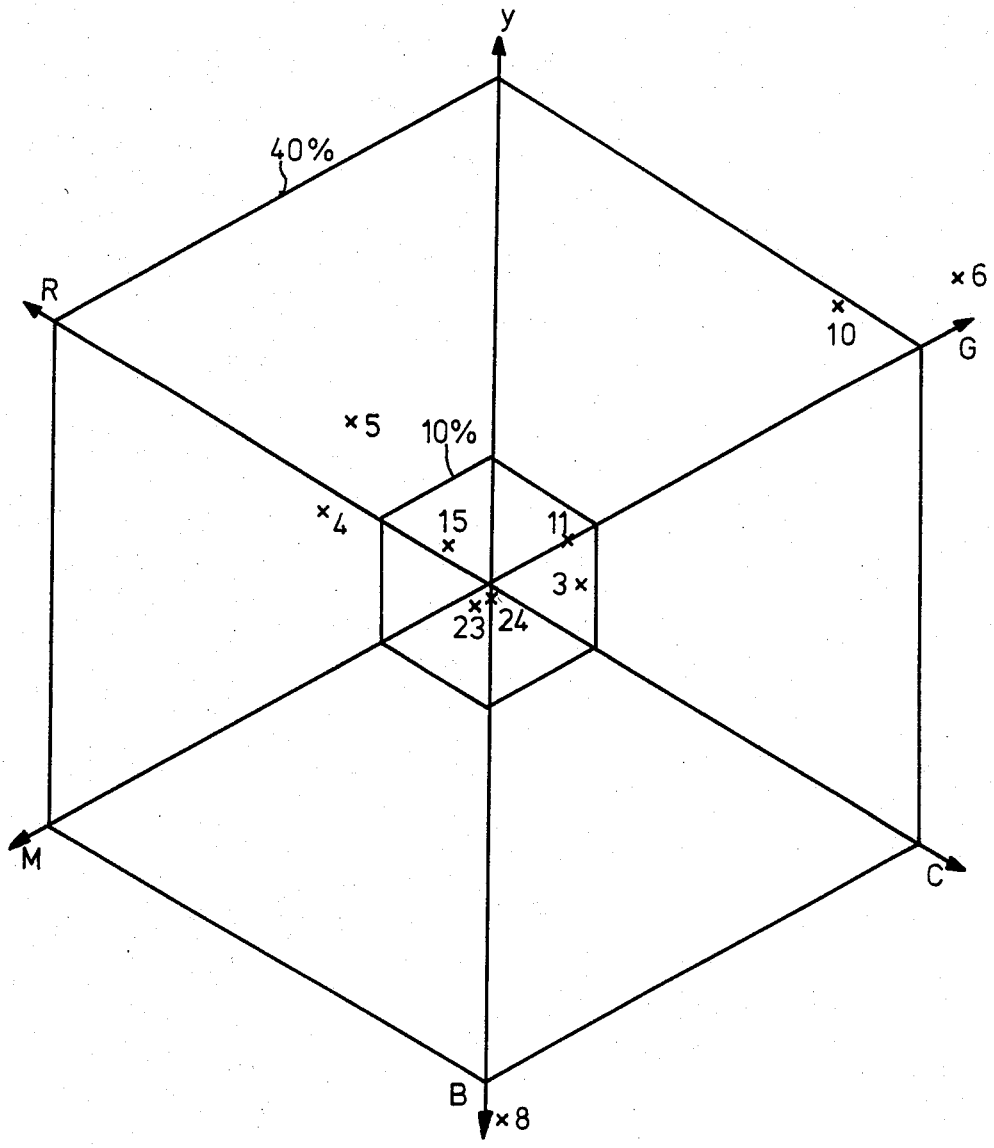

COLOR PHOTOGRAPHIC RECORDING MATERIAL FOR THE PRODUCTION OF COLOR IMAGES VIEWED BY REFLECTED LIGHT

This invention relates to a light-sensitive colour photographic recording material having a light-reflecting layer support and, arranged thereon, at least three light-sensitive silver halide emulsion layers differing in spectral sensitivity and spectrally associated therewith, respectively, a cyan coupler, a magenta coupler and a yellow coupler. By suitable choice of particular couplers, the recording material obtained produces images which are neutral in colour and have a high storage stability.

It is known to produce colour photographic images by chromogenic development, i.e. a process in which silver halide emulsion layers which have been image-wise exposed are developed using suitable colour-forming developer substances, so-called "colour developers" in the presence of suitable colour couplers. In this process, the developer oxidation product produced in correspondence with the silver image reacts with the colour coupler to form a dye image. The colour developers used are usually aromatic compounds containing primary amino groups, in particular those of the p-phenylene diamine series.

The colour couplers and the dyes obtained therefrom by chromogenic devleopment should satisfy various practical requirements. The speed with which the colour couplers couple with the oxidation product of the colour developer should be as high as possible. Both the colour couplers and the dyes obtained therefrom should be sufficiently stable to light, elevated temperature and moisture. This applies both to the unprocessed and to the processed recording materials. For example any residue of coupler left in the image white of the processed material should not undergo yellowing. In addition, the dyes should be sufficiently resistant to gaseous reducing or oxidising agents, they should be fixed in a diffusion-fast form in the image layer and they should be deposited as a very fine grain in the process of chromogenic development. In addition, the mechanical properties of the layers should not be impaired by the colour couplers and the dyes produced from the colour couplers in the course of chromogenic development should have a suitable absorption curve, with a maximum corresponding to the colour of the desired partial image, with as little side adsorption as possible.

In the ideal case, a cyan dye should absorb red light almost completely and be substantially transparent to blue and green light, a magenta dye should absorb green light almost completely and be substantially transparent to blue and red light, and a yellow dye should absorb blue light almost completely and be substantially transparent to green and red light.

Colour photographic recording materials normally contain at least one predominantly blue-sensitive, one predominantly green-sensitive and one predominantly red-sensitive silver halide emulsion layer arranged one above the other on a layer support. If the blue-sensitive layer is arranged uppermost in the layer combination, a layer containing a yellow filter dye may be arranged below it and above the green- and red-sensitive layers. Intermediate layers may also be arranged between two silver halide emulsion layers of differing spectral sensitivities. The light-sensitive silver halide emulsion layers generally have non-diffusible colour couplers spectrally associated therewith. The conventional spectral arrangement provides that the absorption range of the dyes obtained from the colour couplers in the course of development substantially corresponds with the region of predominant spectral sensitivity of the associated silver halide emulsion. This means that a yellow coupler is associated with the predominantly blue-sensitive silver halide emulsion layer, a magenta coupler with the predominantly green-sensitive silver halide emulsion layer and a cyan coupler with the predominantly red-sensitive silver halide emulsion layer, but different spectral arrangements are also possible for particular purposes. For producing images to be viewed by reflected light, the light-sensitive layers are generally arranged on an opaque, light-reflecting layer support.

Although many colour couplers are known to satisfy the criteria mentioned above, in particular in that they give rise, on colour coupling, to dyes which are comparatively stable to light, elevated temperature and moisture, one problem which has not yet been satisfactorily solved is that of providing colour photographic materials capable of giving rise to colour images which are not only neutral in colour, but also preserve the colour neutrality thereof under conditions of prolonged storage, whether stored under exposure to light or in the dark, e.g. in living rooms or in photograph albums. It is in most cases found in practice that colour images generally change colour character in the course of storage and develop a more or less pronounced colour tinge when stored in the light or even in the dark. That this is regarded as a serious problem in practice is clear, for example, from the following publications:

Herkstroeter:J.A.C.S. 95, 8686 (1973); J.A.C.S. 98, 330 (1976); J.A.C.S. 98, 6210 (1976).

R. J. Tuite: Image Stability in Color Photography Journ. Appl. Photographic Engineering 5 (4) (1979).

T. Miyogawa: Stabilität sowie Ver- und Entfäbung von Farbphotographien Nikon shashin gakkaishi: 38, 247–260 (1975); Mechanismus Lightfading von pp-Azomethinen: Photogr. Science and Engineering Vol. 20, 140 (1976). Predicting Long-Term Dark Storage Dye Stability Charakteristics: J. Appl. Photogr. Engineering 6 (2) 42 (1980).

H. Wilhelm: Tungsten light fading of Reflection Colour-prints SPSE-Symposium, Ottawa 29.8.-1.9.1982.

See also Photogr. Science and Engineering 11, (5), 295 (1967).

As regards the insufficient stability of the dyes to light, certain improvements have been achieved by the addition of various substances, in particular UV absorbents, such as hydroxyphenyl benzotriazoles, hydroxybenzophenones, benzal malonic acid derivatives or benzal cyanoacetic esters, or anti-oxidants acting as dye stabilizers, radical-binding agents, metal inactivators or peroxide decomposers, e.g. hydrochromans, sterically-hindered amines or phenols or organic metal chelates, for example nickel chelates. Improvements have also been obtained in the stability of the dyes to heat or moisture (dark-fading), e.g. by sterically-hindered p-hydroxybenzoic acid phenyl esters, hydroxyphenyl benzothiazoles or sterically-hindered amines.

It is an object of the present invention to provide a colour photographic recording material having colour couplers incorporated therein for the three partial colour images, cyan, magenta and yellow, which material is distinguished by the improved stability of the image dyes to light, as well as heat and moisture, and which is particularly distinguished by the fact that the stability in the dark (dark fading) is improved. While the overall loss in colour density should be as low as possible, the loss in colour density in the three partial colour images, cyan, magenta and yellow, should be as equal and synchronous as possible so that a neutral grey impression of the image will be preserved even under prolonged storage under the ambient conditions in living rooms and under conditions of elevated temperature and moisture.

The present invention relates to a colour photographic recording material having a light-reflecting layer support and, arranged thereon, at least three light-sensitive silver halide emulsion layers differing in spectral sensitivity and having colour couplers spectrally associated with the said layers, a 2-acylaminophenol compound being associated as cyan coupler with a red-sensitive silver halide emulsion layer, a pyrazolone compound as magenta coupler with a green-sensitive silver halide emulsion layer and an open-chain ketomethylene compound as yellow coupler with a blue-sensitive silver halide emulsion layer, characterised in that the cyan coupler is a coupler corresponding to the following general formula (I):

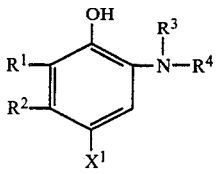

(I)

wherein $R^1$ represents H or halogen, e.g. chlorine or bromine;

$R^2$ represents alkyl having at least 2 carbon atoms, such as ethyl, propyl, butyl, t-amyl or n-pentadecyl;

$R^3$ represents H or alkyl having up to 5 carbon atoms;

$R^4$ represents acyl; and $X^1$ represents H or a group releasable in the course of colour coupling;

the magenta coupler is a 3-anilinopyrazolone coupler and the yellow coupler is a 2-equivalent yellow coupler derived from pivaloylacetanilide.

An acyl group represented by $R^4$ may be in particular an acyl group derived from aliphatic or aromatic carboxylic acids, in particular from alkyl-, alkoxy- or aroxy-substituted carboxylic acids.

In a preferred embodiment of the present recording material, the cyan coupler corresponds to general formula (II), the magenta coupler to general formula (III) and the yellow coupler to general formula (IV) as follows:

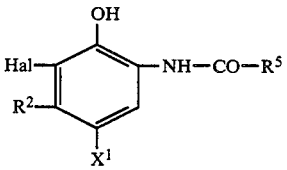

(II)

wherein

Hal represents halogen, e.g. chlorine or bromine;

$X^1$ represents H or a group releasable in the process of colour coupling;

$R^2$ represents alkyl having from 2 to 20 carbon atoms, in particular ethyl, propyl or butyl; and $R^5$ represents alkyl, aryl, alkoxyalkyl, aroxyalkyl, alkoxy or alkylamino or arylamino;

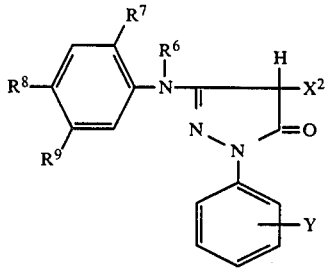

(III)

wherein $R^6$ represents H or alkyl;

$R^7$ represents H or halogen, such as chlorine, or alkoxy;

$R^8$ represents H, halogen or $R^9$;

$R^9$ represents acylamino, $—COOR^{10}$, $—CO—NR^{11}R^{12}$ or cycloimido;

$R^{10}$ represents alkyl;

$R^{11}$ represents H or $R^{12}$;

$R^{12}$ represents alkyl;

$X^2$ represents H or a group releasable in the process of colour coupling; and

Y represents H or one or more identical or different substituents, e.g. alkyl, alkoxy, halogen, alkylsulphone, arylsulphone, acylamino or sulphamoyl;

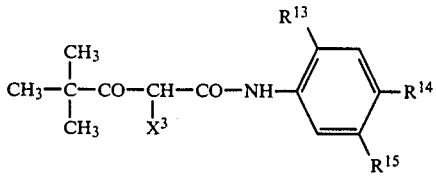

(IV)

wherein $R^{13}$ represents H, halogen, alkoxy or dialkylamino;

$R^{14}$ represents H, alkyl, alkoxy or halogen;

$R^{15}$ represents $—NR^{16}—CO—R^{17}$, $—NR^{16}—SO_2—R^{17}$, $—CO—R^{18}$ or $SO_2—NR^{16}R^{17}$;

$R^{16}$ represents H or alkyl;

$R^{17}$ represents alkyl, aralkyl or aroxyalkyl;

$R^{18}$ represents alkyl, alkoxy, aryloxy or alkylamino; and $X^3$ represents a group attached via an oxygen atom or a nitrogen atom which is releasable in the process of colour coupling.

An aroxyalkyl group represented by $R^5$ preferably has the following structure:

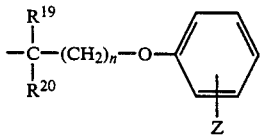

wherein $R^{19}$ and $R^{20}$ independently represent H or alkyl;

n represents 0 or an integer of from 1 to 3; and

Z represents one or more, preferably two, alkyl groups having from 1 to 16 carbon atoms, the sum of the carbon atoms in Z and $R^{20}$ amounting to at least 8.

In the acylamino groups, as represented, for example, by $R^9$ or Y, the acyl group is derived from an aliphatic or aromatic carboxylic or sulphonic acid or from carbamic acid or a carbonic acid semi-ester. $R^9$ preferably has the following structure:

$$-NH-CO-R^{21}$$

wherein $R^{21}$ represents an alkyl or alkoxy group which confers diffusion resistance.

A cycloimido group represented by $R^9$ may be, for example, a phthalimido, tetrahydrophthalimido or succinimido group substituted with an aliphatic group conferring diffusion resistance.

An aroxyalkyl group represented by $R^{17}$ preferably has a structure as defined for $R^5$.

The groups represented by $X^1$, $X^2$ and $X^3$ capable of being released in the course of colour coupling include in particular those which impart to the particular couplers the properties of 2-equivalent couplers. They may consist of various molecular groupings, in particular those which produce a photographic effect after they have been released from the coupler molecule. Examples include aryloxy, sulphamido and heterocyclic groups which may be attached to the coupling position of the coupler by, for example, a ring nitrogen atom. The groups which develop a photographic activity after release from the coupler molecule may be, for example, groups of development inhibitors, which may be attached to the coupling position of the coupler either directly or via a time-controlling intermediate member. $X^3$ is preferably a group corresponding to the following general formula:

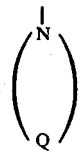

wherein

Q represents a group for completing a substituted or unsubstituted imidazole, pyrazole, triazole, oxazole, thiazole or thiadiazole ring.

In the following are given examples of cyan couplers which may be used according to the present invention in combination with the corresponding magenta couplers and yellow couplers:

C-1

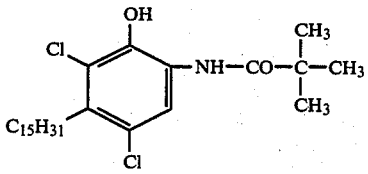

C-2

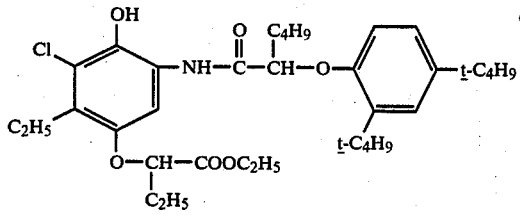

C-3

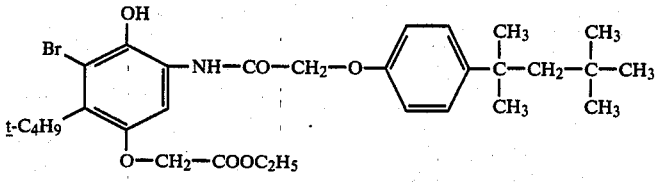

C-4

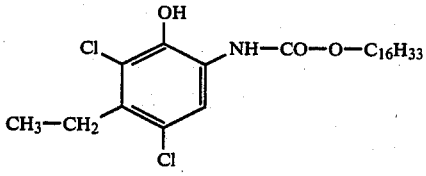

C-5

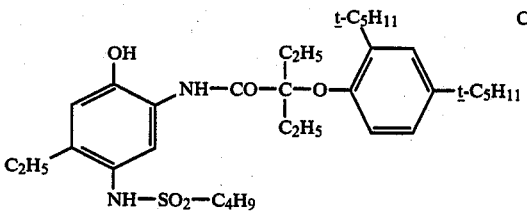

C-6

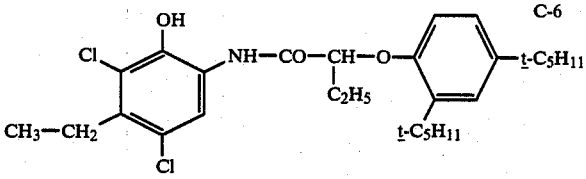

C-7

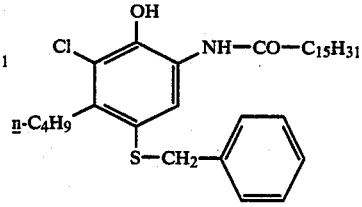

C-8

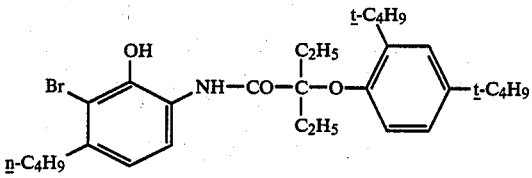

C-9

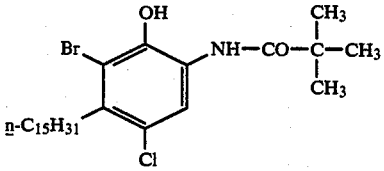

-continued
C-10
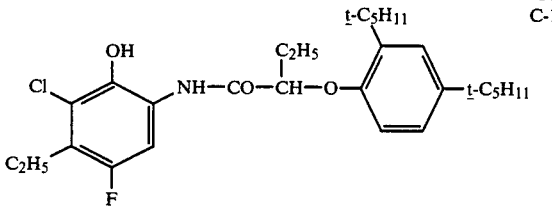
C-11
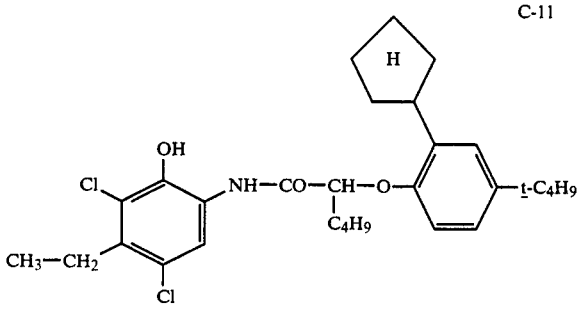
C-12
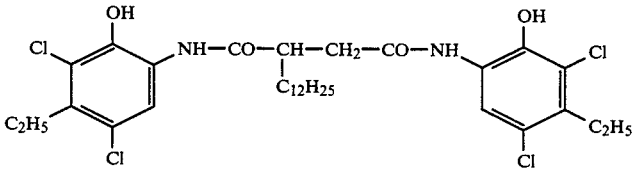
C-13
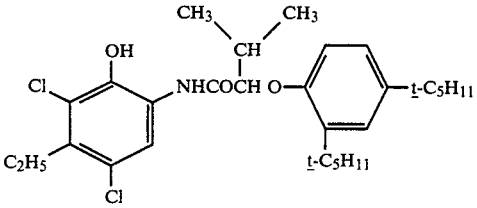
C-14
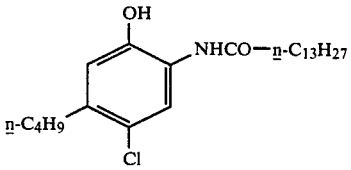
C-15
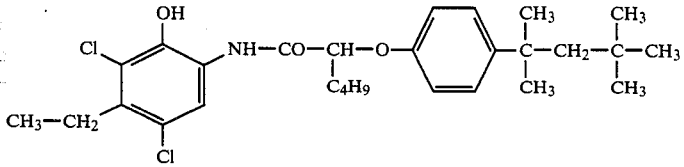
C-16
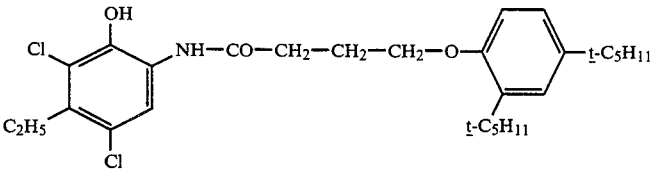
C-17
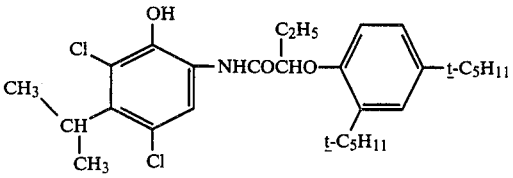
C-18
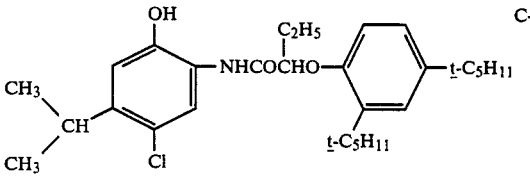
C-19
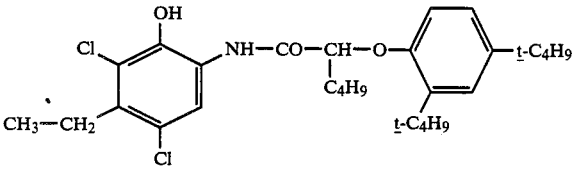
C-20
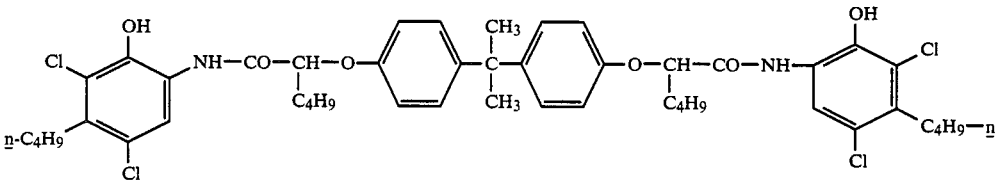

-continued
C-21
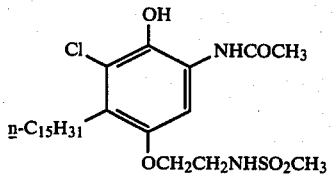
C-22
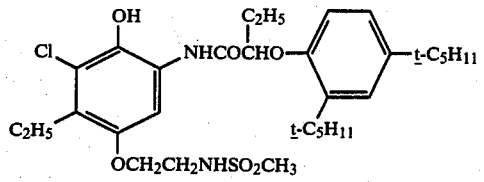
C-23
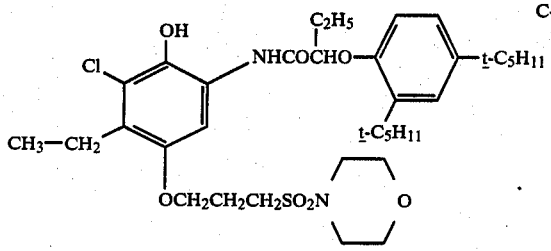
C-24
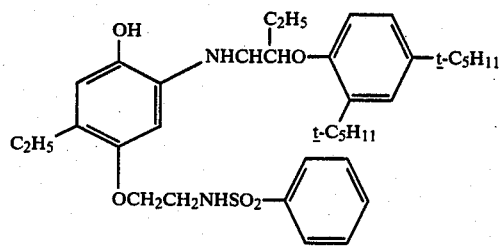
C-25
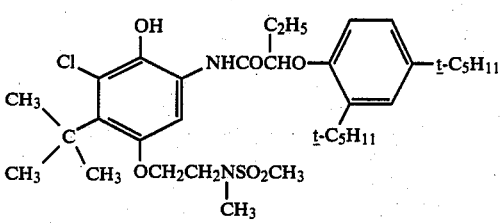
Examples of magenta couplers which may be used according to the present invention in combination with appropriate cyan couplers and yellow couplers are illustrated below:
M-1
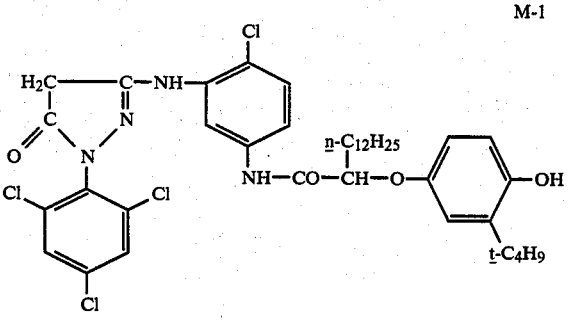
M-2
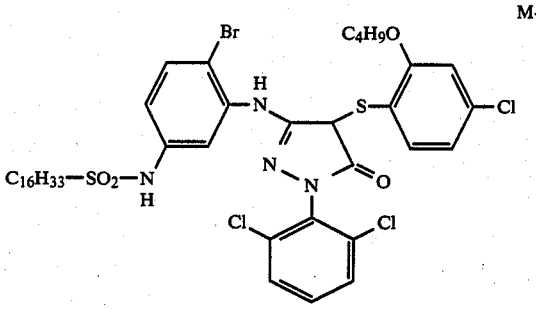
M-3
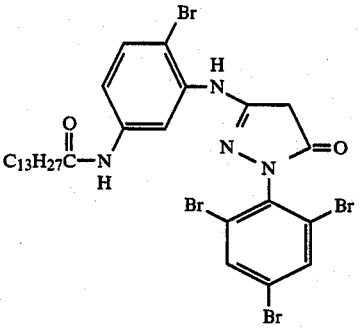
M-4
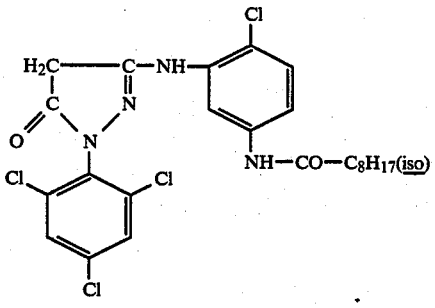

-continued
M-5
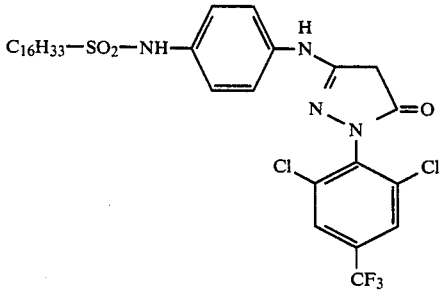
M-6
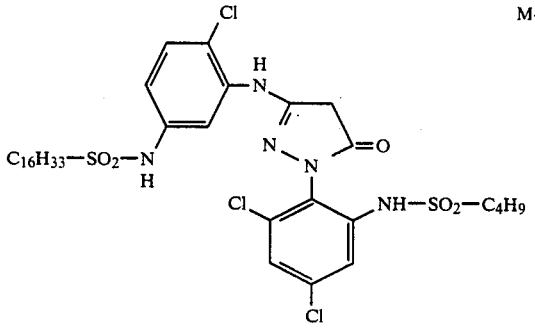
M-7
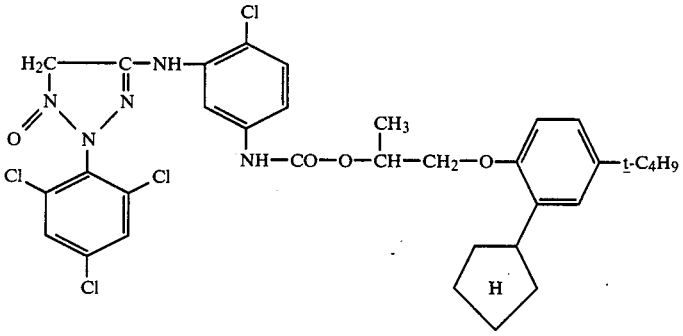
M-8
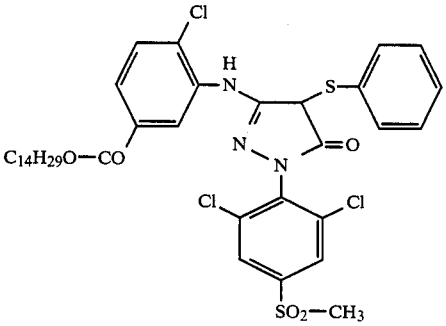
M-9
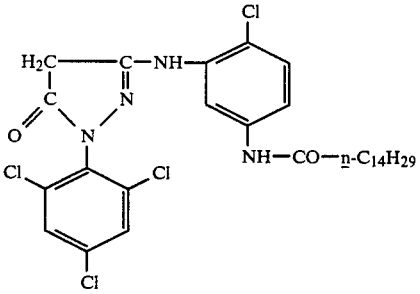
M-10
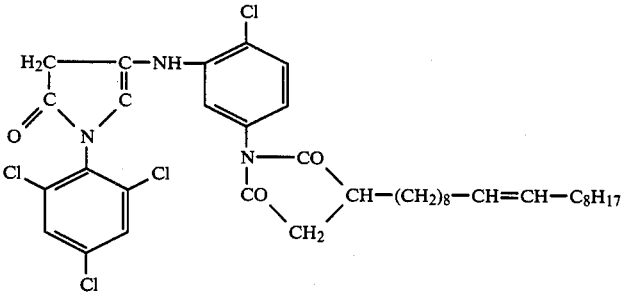
M-11
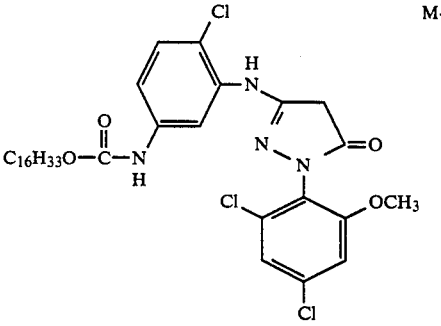
M-12
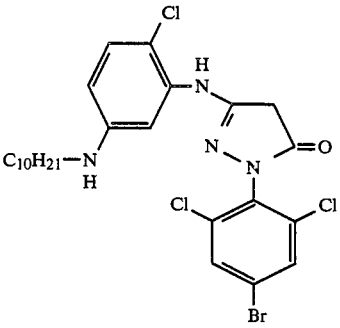

-continued
M-13
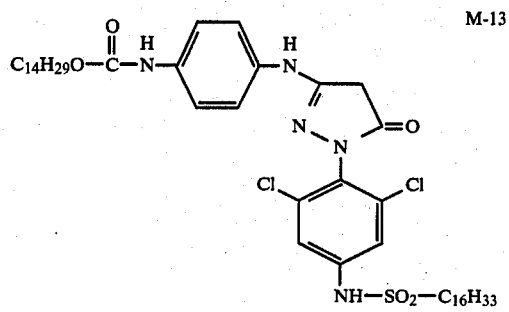
M-14
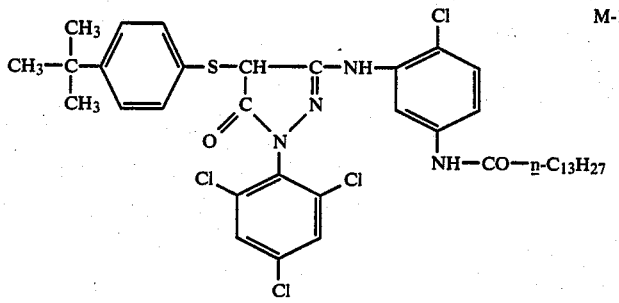
M-15
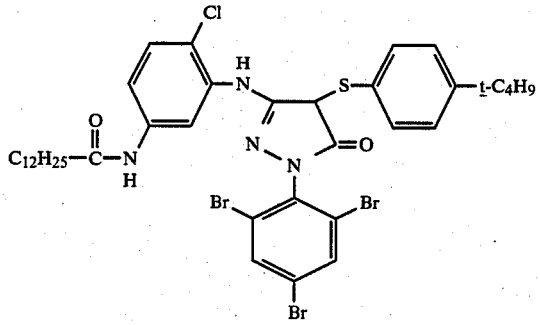
M-16
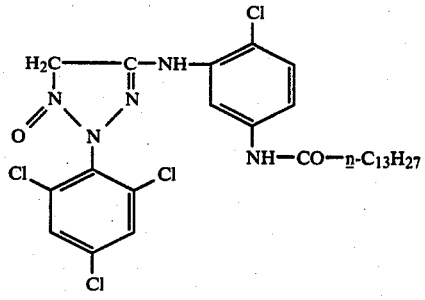
M-17
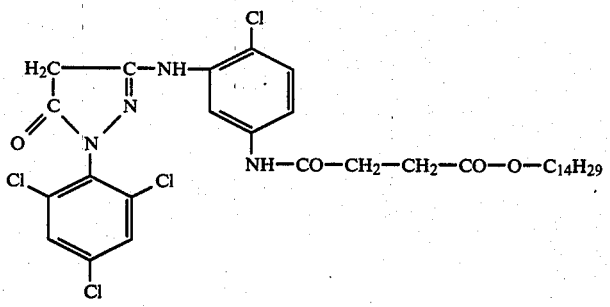
M-18
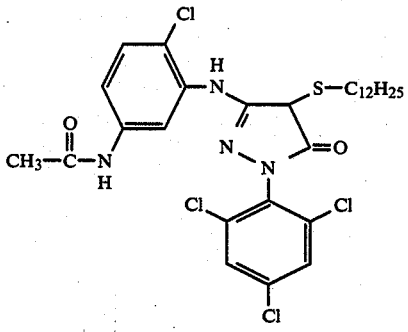
M-19
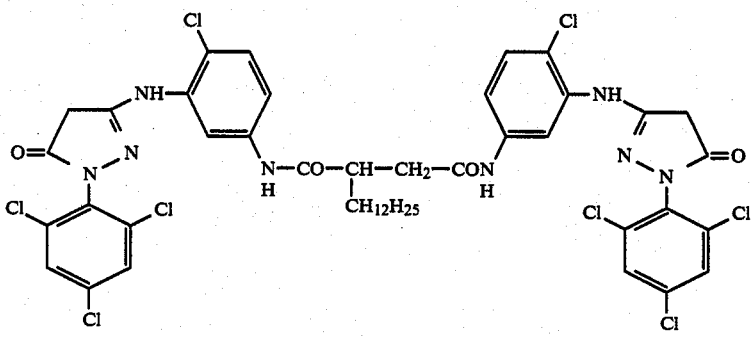

-continued
M-20
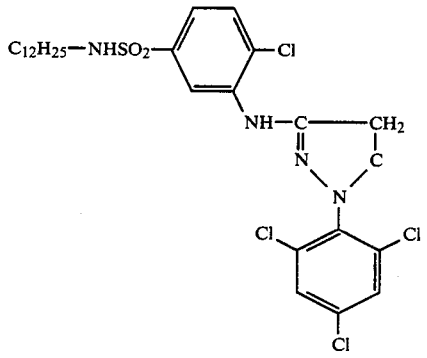
M-21
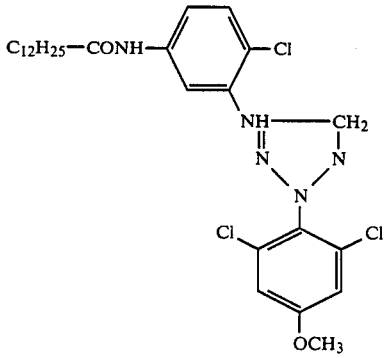
M-22
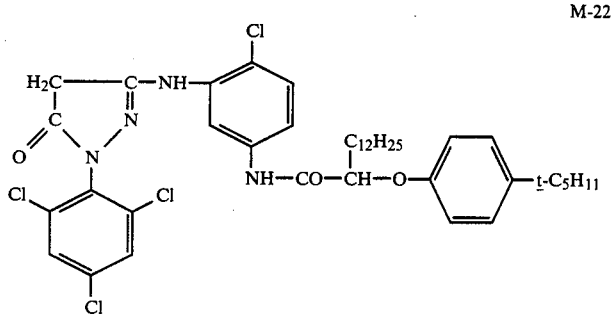
M-23
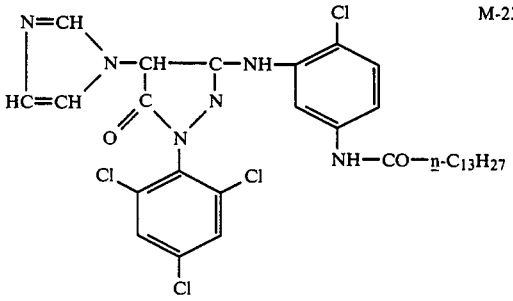
M-24
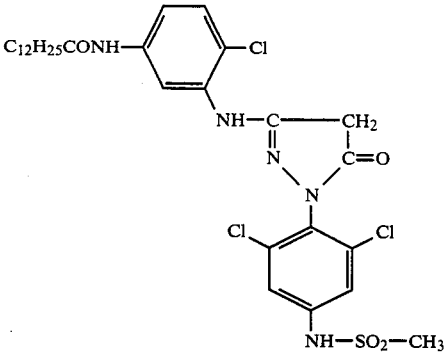
M-25
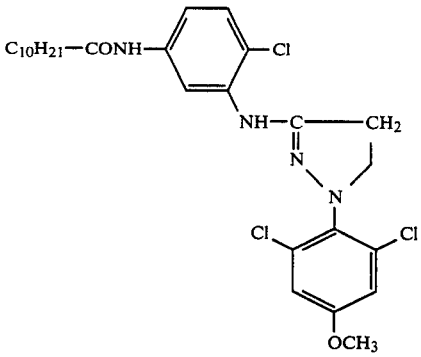
M-26
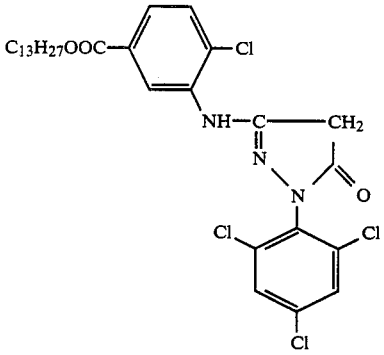
M-27
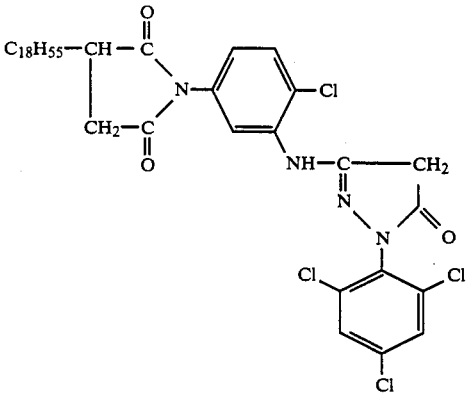

-continued
M-28
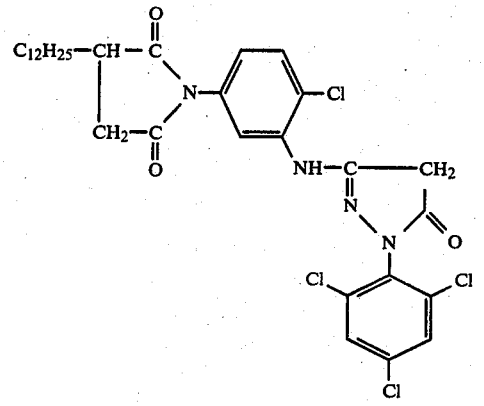
M-29
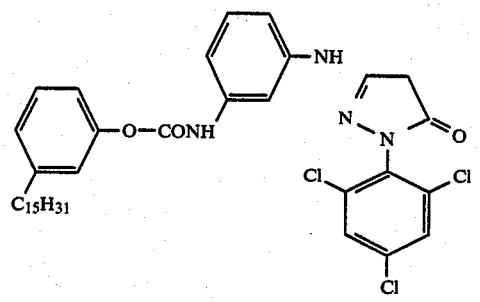
M-30
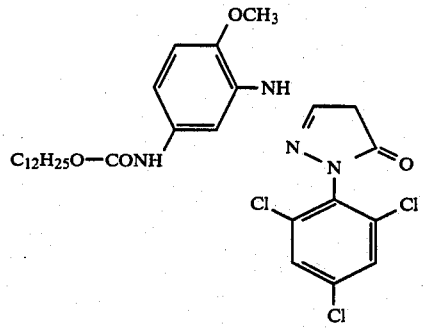
M-31
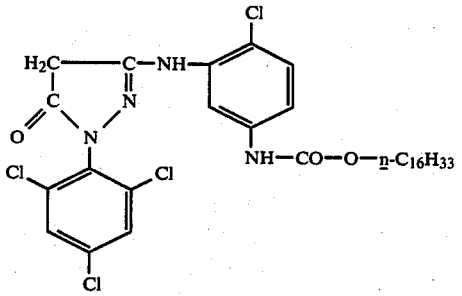
M-32
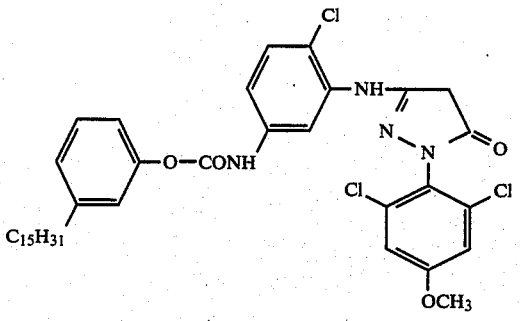
M-33
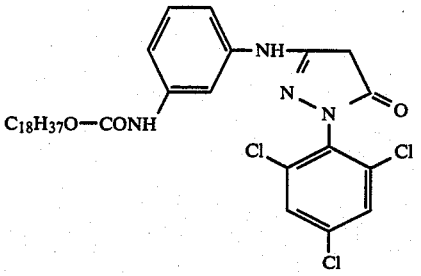
M-34
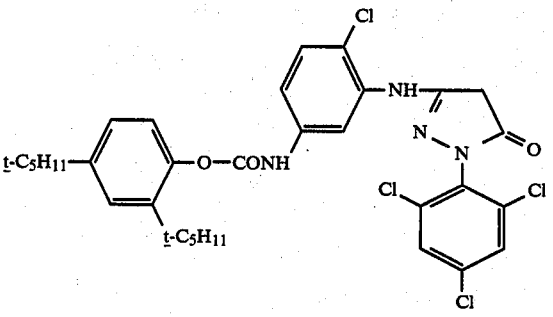
M-35
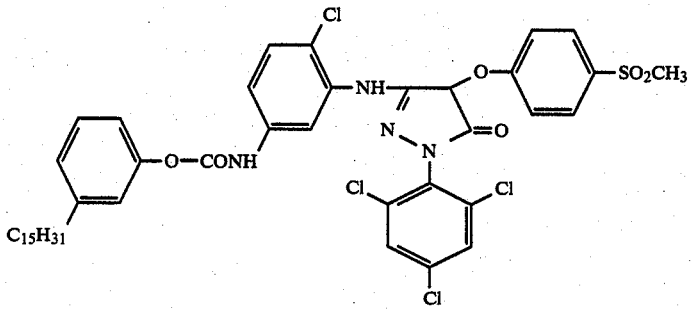

-continued
M-36
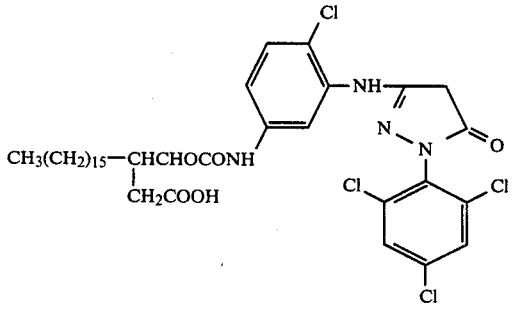
M-37
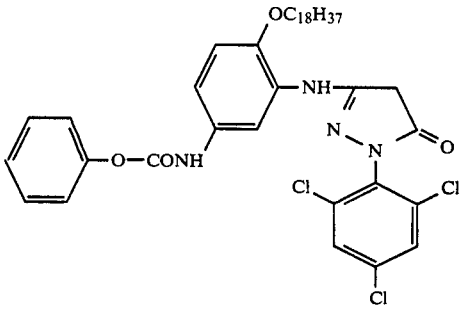
M-38
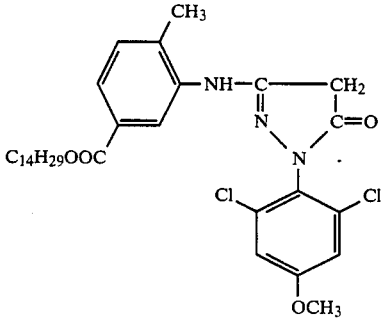
M-39
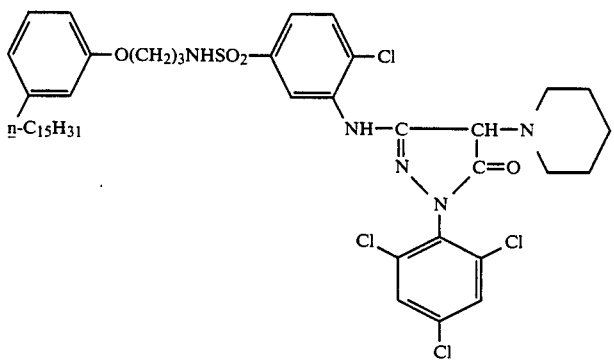
M-40
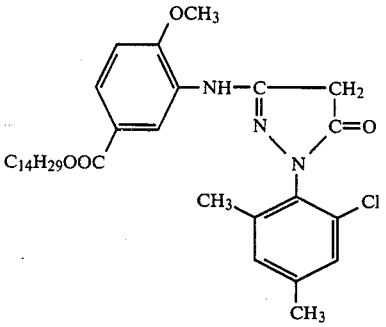
M-41
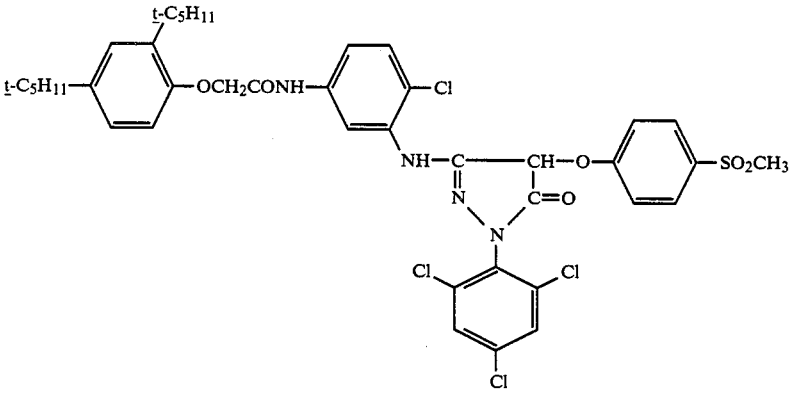

-continued
M-42
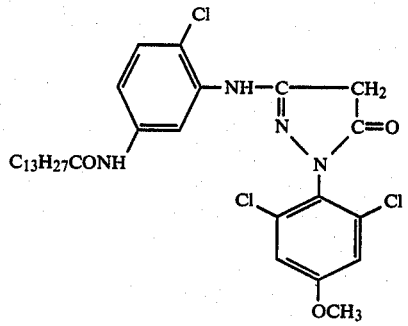
Examples of yellow couplers which may be used according to the present invention in combination with the appropriate cyan couplers and magenta couplers are illustrated below:
Y-1
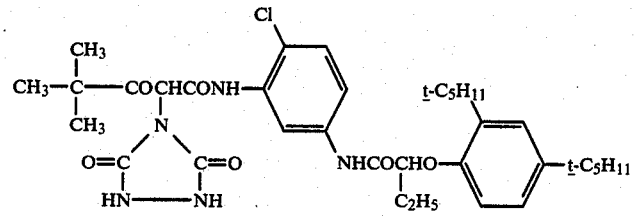
Y-2
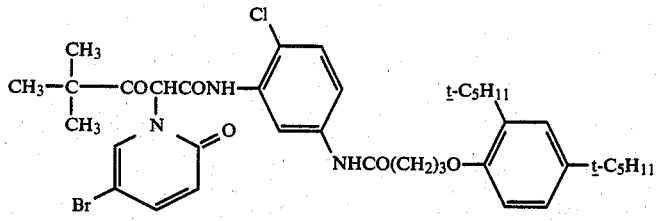
Y-3
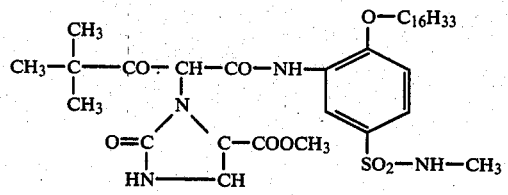
Y-4
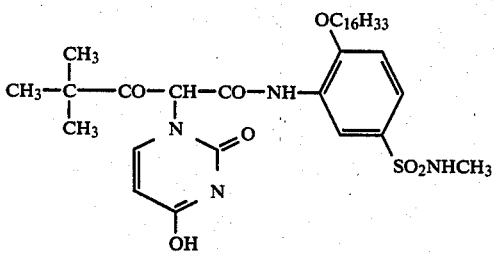
Y-5
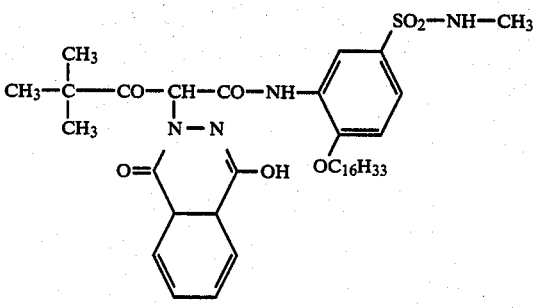

-continued
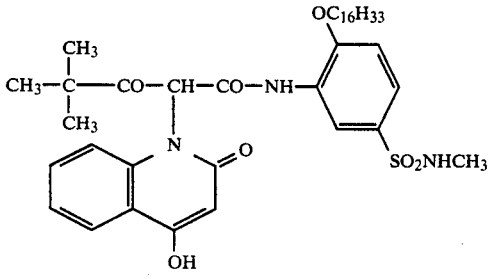
Y-6
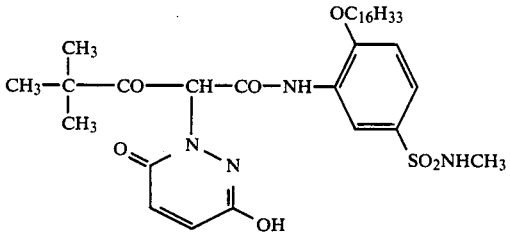
Y-7
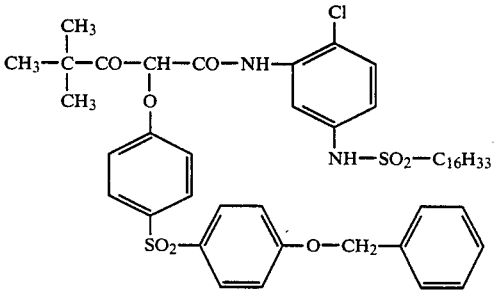
Y-8
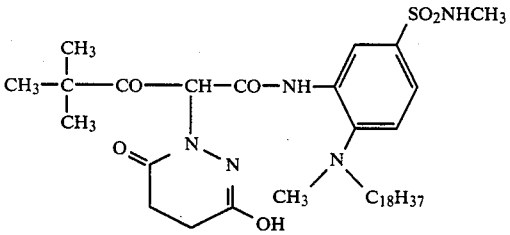
Y-9
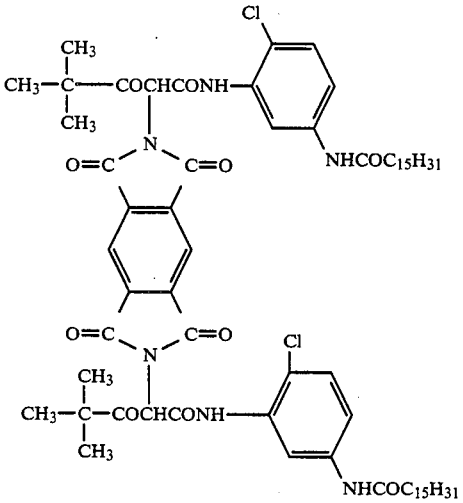
Y-10

-continued
Y-11
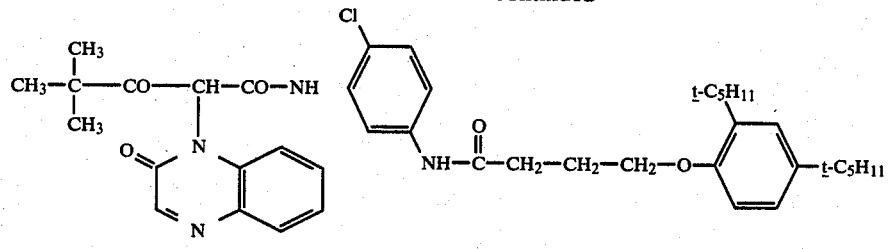
Y-12
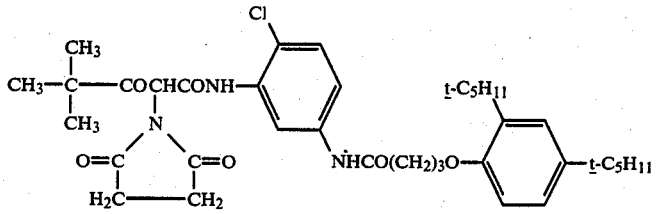
Y-13
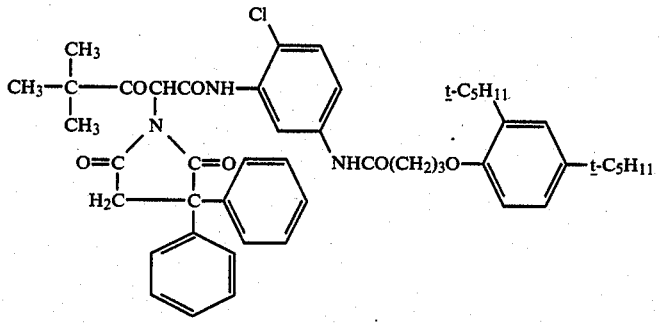
Y-14
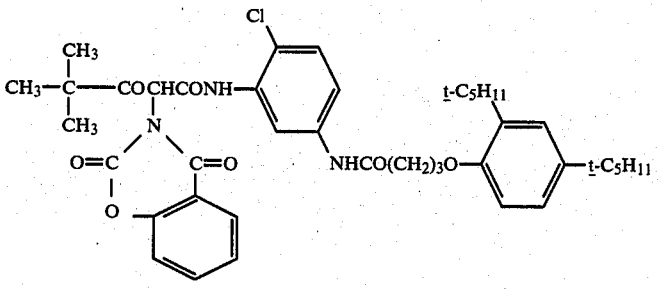
Y-15
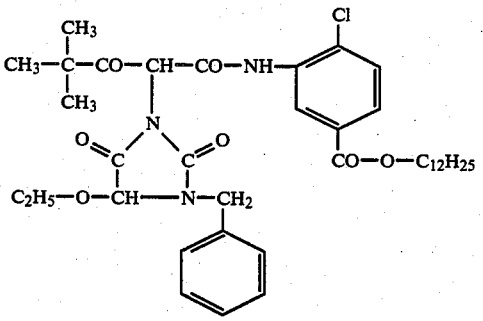
Y-16
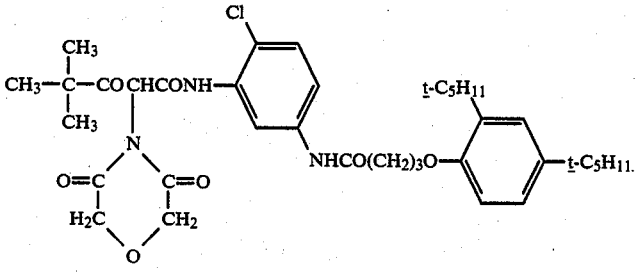

-continued
Y-17
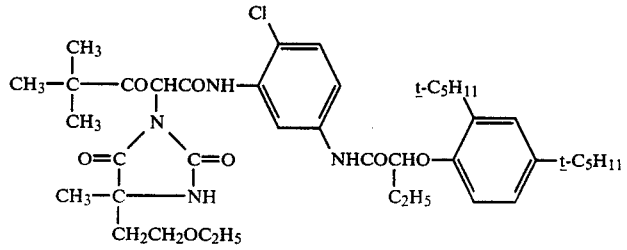
Y-18
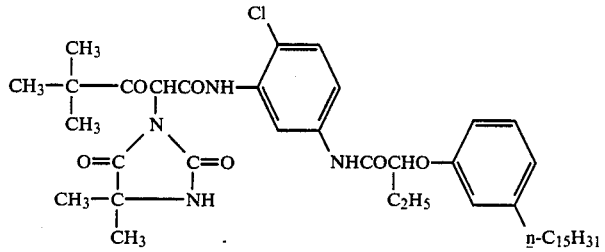
Y-19
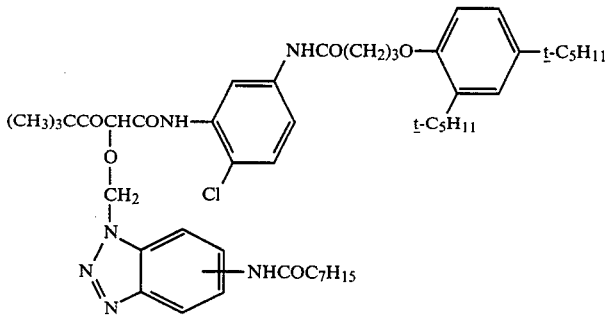
Y-20
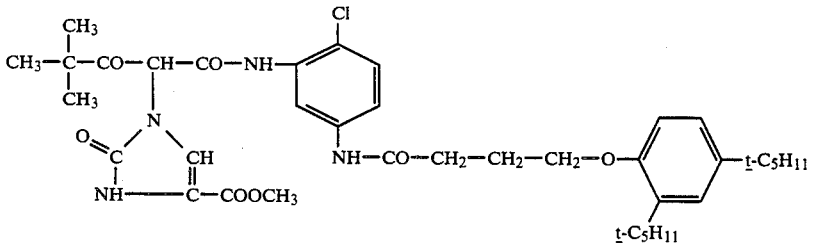
Y-21
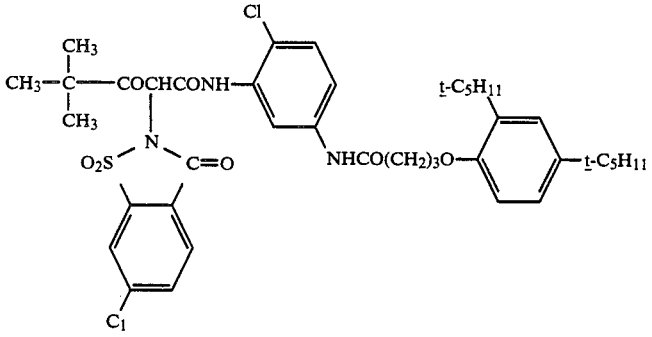

-continued
Y-22
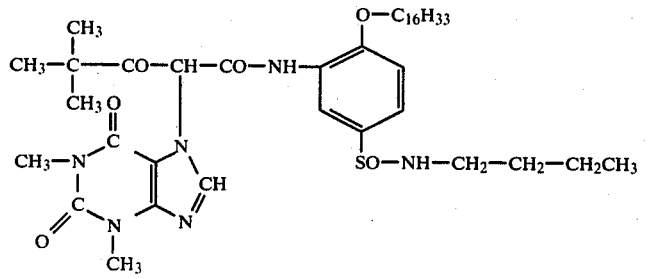
Y-23
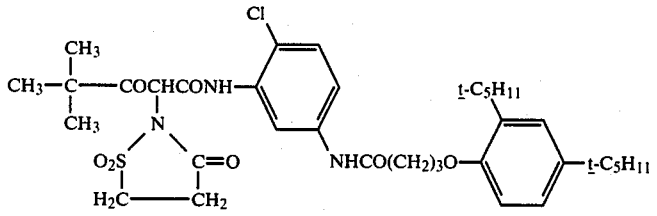
Y-24
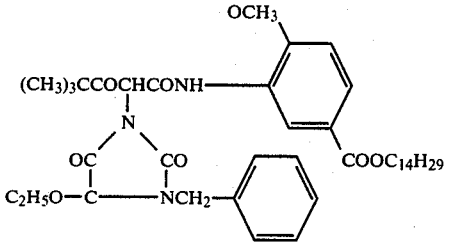
Y-25
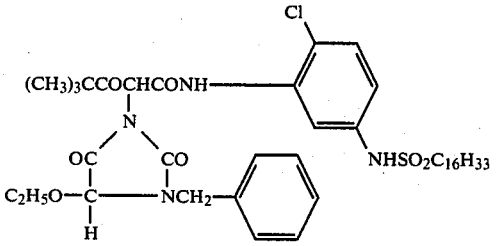
Y-26
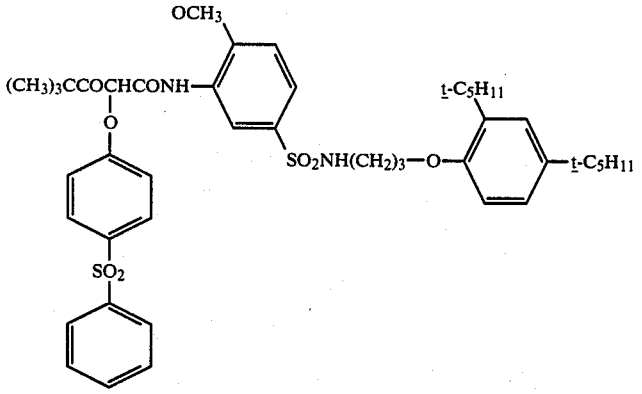
Y-27
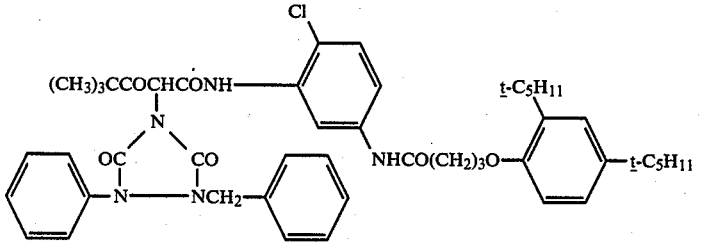

-continued
Y-28
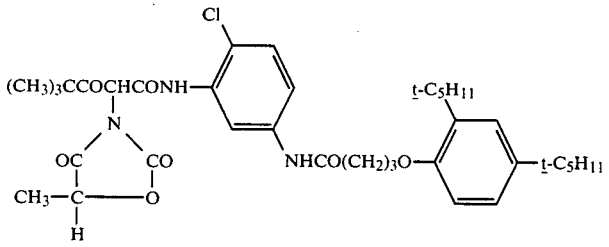
Y-29
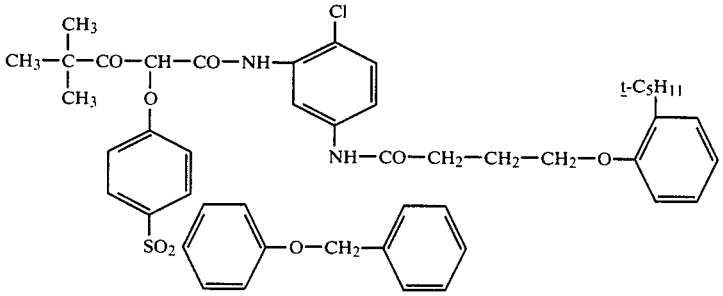
Y-30
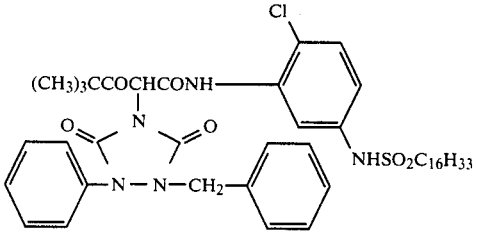
Y-31
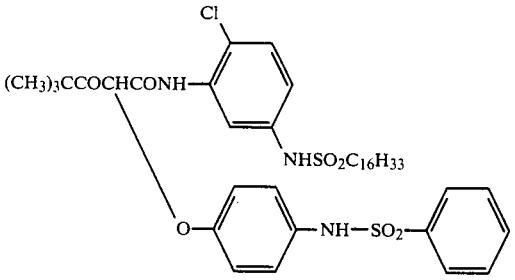
Y-32
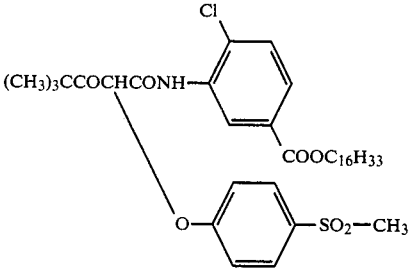
Y-33
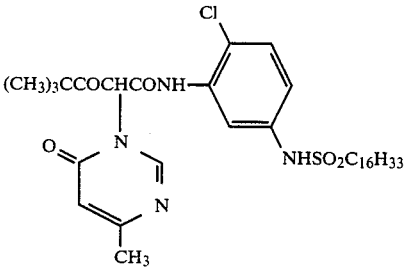

-continued
Y-34
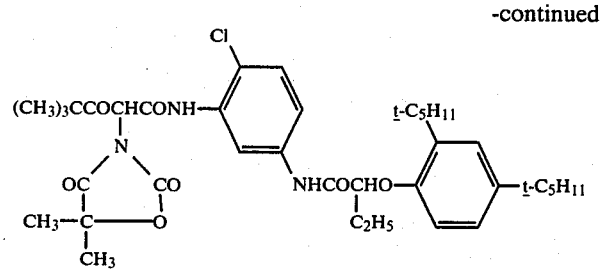
Y-35
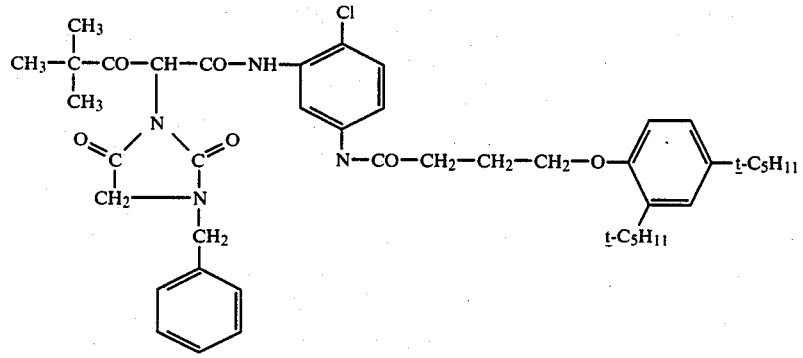
Y-36
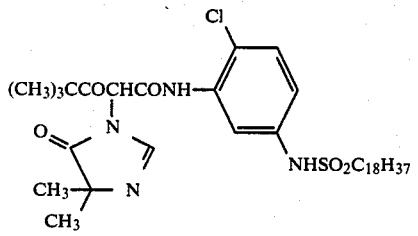
Y-37
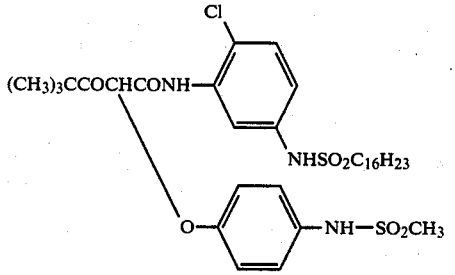
Y-38
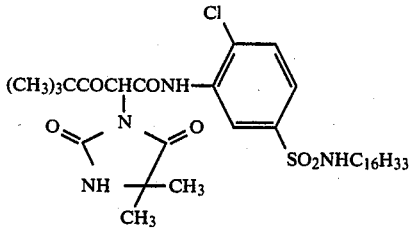
Y-39
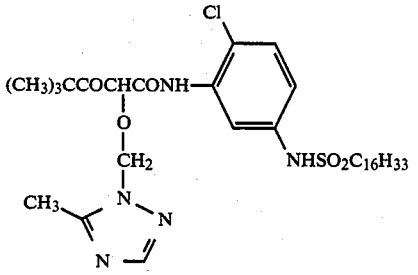

-continued
Y-40
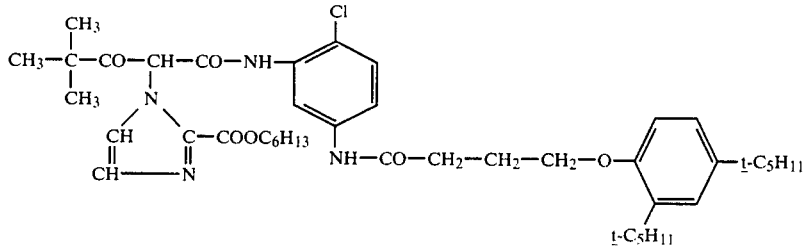
Y-41
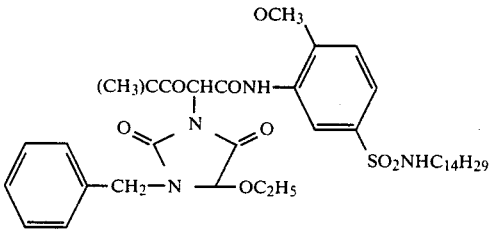
Y-42
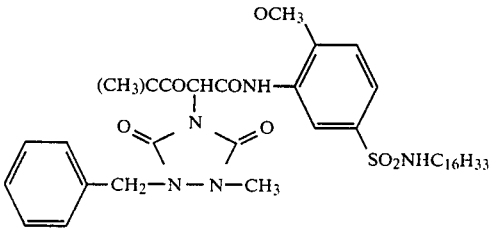
Y-43
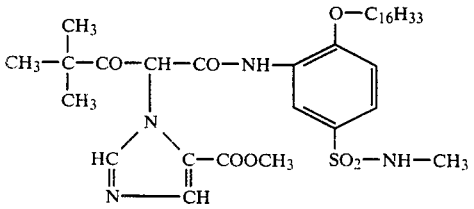
Y-44
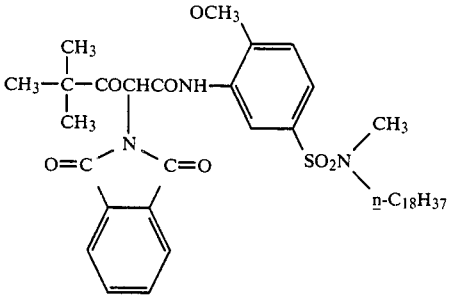
Y-45
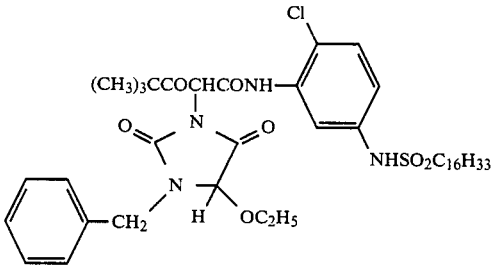

-continued
Y-46
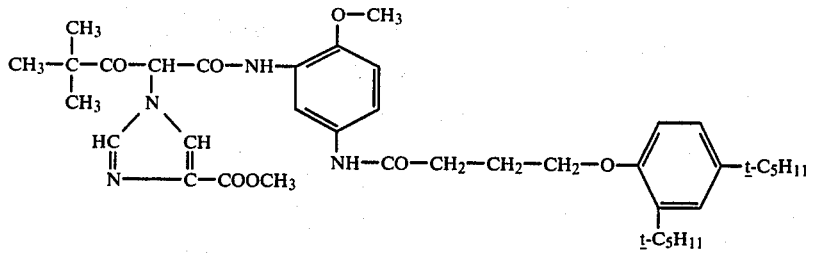
Y-47
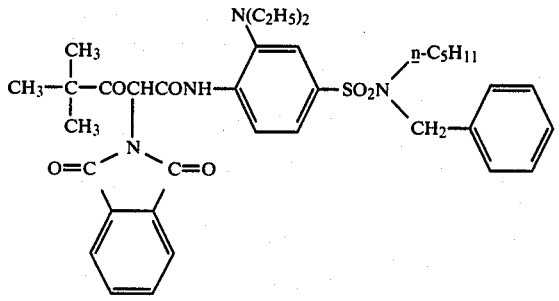
Y-48
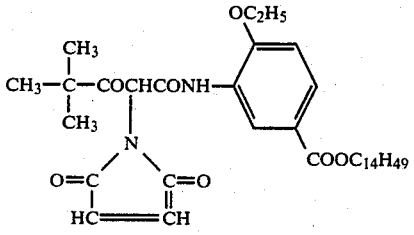
Y-49
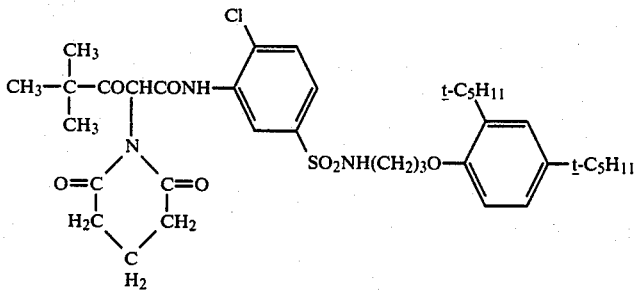
Y-50
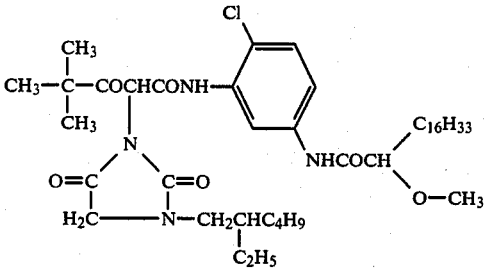
Y-51
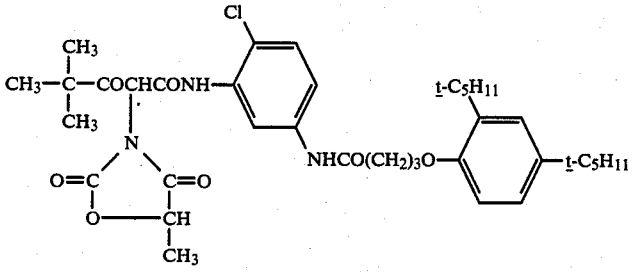

-continued

Y-52

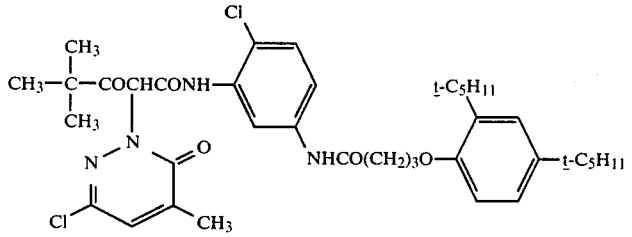

Suitable cyan couplers have been described, for example, in U.S. Pat. No. 3,772,002. Intermediates suitable for the production of these cyan couplers may be obtained, for example, by methods analogous to those described in DE-A-2,216,804. Suitable magenta couplers have been described, for example, in DE-C-1,797,083, DE-A-2,301,705 DE-A-2,300,221, DE-A-2,408,655 and DE-A-2,644,538. Suitable yellow couplers have been described, for example, in DE-B-1,124,356, DE-A-2,329,587, DE-A-2,433,812, DE-A-2,528,638 and DE-A-2,842,063.

The above-mentioned colour couplers are incorporated in the colour photographic recording material in the conventional manner by the known emulsion techniques, in each case in association with a suitably spectrally sensitized silver halide emulsion layer. By "association" is meant that the relative spatial arrangement of silver halide emulsion and colour coupler is such that, when development takes place, interaction there between is possible to give rise to an imagewise correspondence between the silver image formed and the dye image. For this purpose, the colour coupler is generally incorporated directly in the silver halide emulsion layer or in a layer adjacent thereto. In addition to the conventional spectral association, in which the absorption range of the dye formed from a colour coupler substantially corresponds to the range of the predominant sprectral sensitivity of the associated silver halide emulsion layer, other spectral associations are possible for particular purposes.

When choosing cyan couplers, magenta couplers and yellow couplers in accordance with the present invention, it is possible to prepare colour photographic recording materials for producing coloured reflection-viewed images which are very stable and in particular retain the neutral colour character thereof over periods of prolonged storage both in the dark and in the light.

Further improvement in the stability of the image dyes against light, heat and moisture may be obtained in the colour photographic material according to the present invention in known manner by means of other suitable additives, e.g. in the form of UV absorbents, antioxidants, radical-binding agents, metal inactivators or peroxide decomposers. Examples include hydroxyphenyl-benzotriazoles, stilbene derivatives, hydrochromans, sterically-hindered amines or phenols and certain metal chelates. Such compounds may be incorporated in one or more layers of the colour photographic recording material according to the present invention.

EXAMPLE

The following layers were applied to a layer support of paper coated on both sides with polyethylene. The quantities given relate to 1 $m^2$.

(1) A substrate layer of 200 mg of gelatine with the addition of $KNO_3$ and chrome alum.

(2) A blue-sensitive silver chlorobromide emulsion layer (5 mol-% chloride) obtained from 600 mg of $AgNO_3$ with 2100 mg of gelatine, 1.1 mmol of yellow coupler, 27.7 mg of 2,5-dioctyl-hydroquinone and 1200 mg of tricresyl-phosphate.

(3) An intermediate layer of 1300 mg of gelatine, 80 mg of 2,5-dioctyl-hydroquinone and 100 mg of tricresyl phosphate.

(4) A green-sensitive silver chlorobromide emulsion layer (20 mol-% chloride) obtained from 530 mg of $AgNO_3$ with 750 mg of gelatine, 0.625 mmol of magenta coupler, 118 mg of α-(3-t-butyl-4-hydroxyphenoxy)-myristic acid ethyl ester, 43 mg of 2,5-dichloro-octyl-hydroquinone, 343 mg of dibutyl phthalate and 43 mg of tricresyl-phosphate.

(5) An intermediate layer of 1550 mg of gelatine, 285 mg of the UV absorbent "Tinuvin 343" ®, 80 mg of dioctylhydroquinone and 650 mg of tricresyl-phosphate.

(6) A red-sensitive silver chlorobromide emulsion layer (20 mol-% chloride) obtained from 400 mg of $AgNO_3$ with 1470 mg of gelatine, 0.780 mmol of cyan coupler, 285 mg of dibutyl-phthalate and 122 mg of tricresyl-phosphate.

(7) A protective layer of 1200 mg of gelatine and 134 mg of "Tinuvin 343" ®.

(8) A hardening layer of 400 mg of gelatine and 400 mg of hardener corresponding to the following formula;

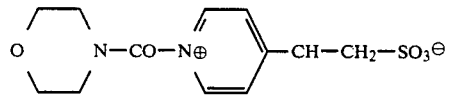

The quantities of coupler and silver halide given above are based on the assumption that the cyan coupler is a 2-equivalent coupler, the magenta coupler a 4-equivalent coupler and the yellow coupler a 2-equivalent coupler. If a 4-equivalent cyan coupler, a 2-equivalent magenta coupler or a 4-equivalent yellow coupler is used instead, the quantities must be altered accordingly to adjust them to the silver/coupler ratio.

Various colour photographic recording materials were prepared using the coupler combinations shown in Tables 1 and 2 below. Recording materials (samples) 1 to 15 contain, for comparison, combinations which are not in accordance with the present invention, i.e. combinations in which at least one of the three colour couplers is not in accordance with the present invention. The colour couplers tested for comparison, denoted by the symbol "V", are indicated below:

Yellow couplers used for comparison:

V1
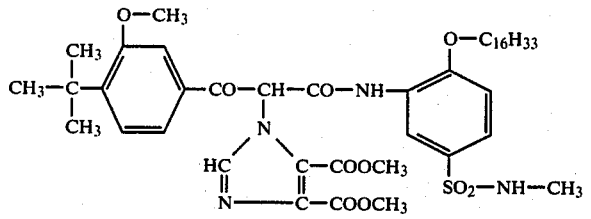
V2
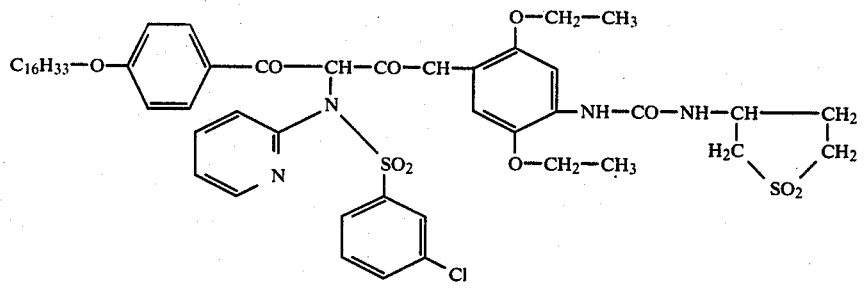
V3
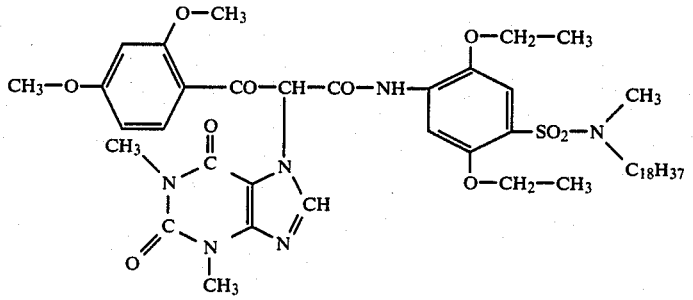
V4
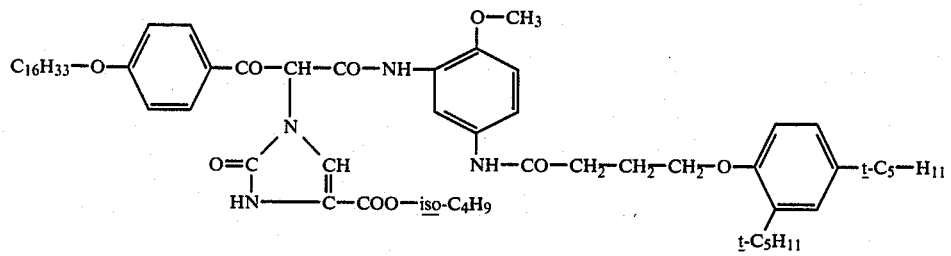
V5
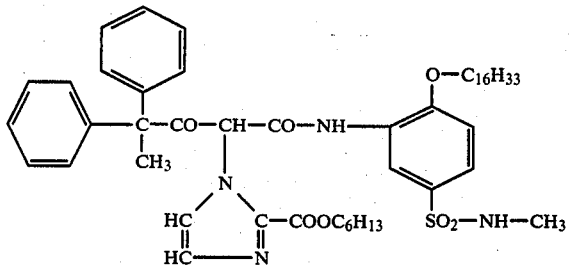
Magenta couplers used for comparison:
V6
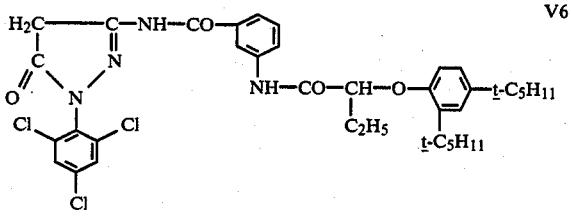
-continued
V7
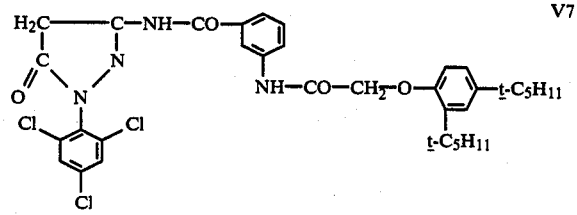

-continued
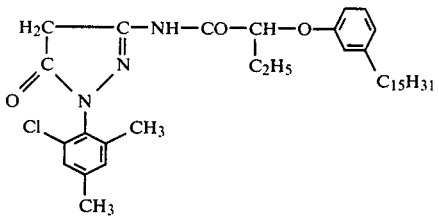
V8
-continued
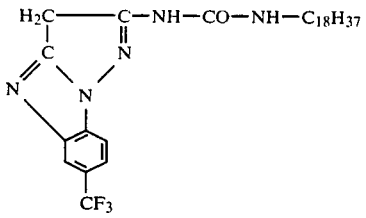
V9
Cyan couplers used for comparison;
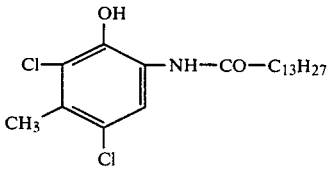
V10
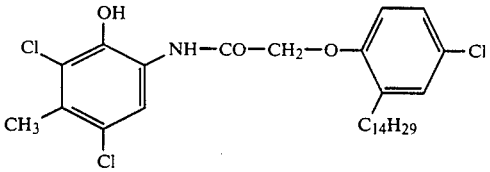
V11
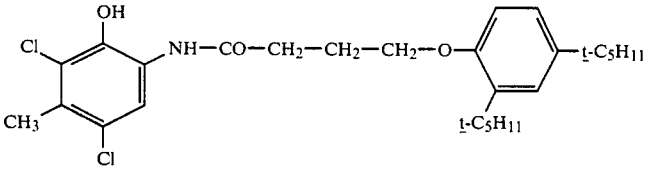
V12
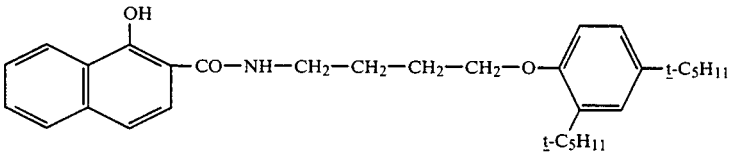
V13
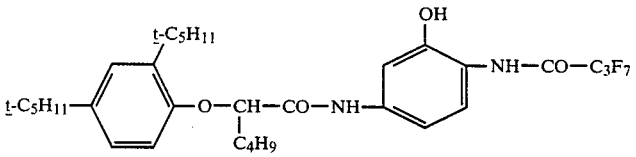
V14
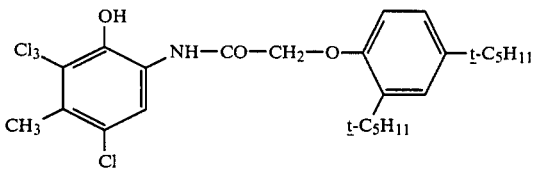
V15
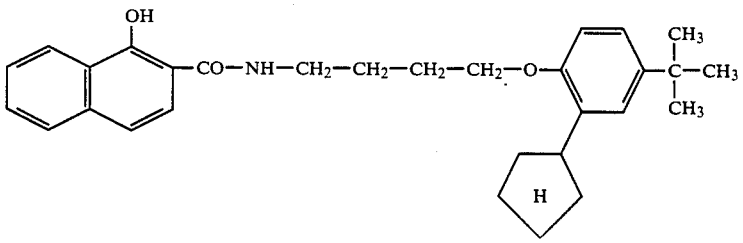
V16

-continued

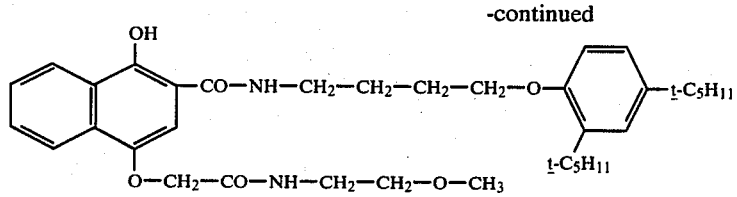

V17

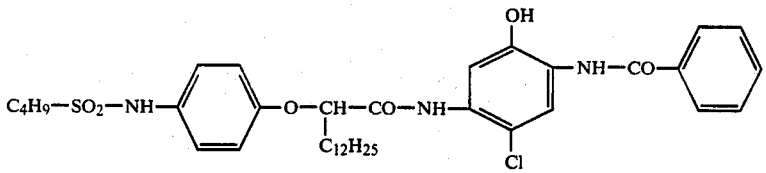

V18

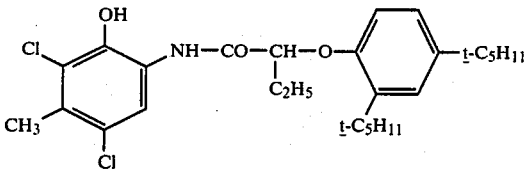

V19

The recording materials prepared as described above were exposed through a grey wedge and processed as described below.

(1) Colour development 210 seconds at 33° C. in a colour developer having the following composition;

15 ml benzyl alcohol
8 ml diethylene glycol
5 g ethylene diaminotetracetic acid (EDTA)
2 sodium sulphite
30 g potassium carbonate
3 g hydroxylamine acetate
0.6 g potassium bromide
5 g 2-amino-5-(N-ethyl-N-methyl-sulphonylaminoethylamino)-toluene-sesquisulphate monohydrate made up with water to 1,000 ml; pH 10.2.

(2) Bleach fixing 90 seconds at 33° C. in a bleach fix bath having the following composition:

2 g EDTA
40 g EDTA-iron-III salt
5 g sodium sulphite
70 g ammonium thiosulphate made up with water to 1,000 ml.

(3) Washing 210 seconds at from 25° to 30° C.

The samples prepared and processed as described above were tested for lightfastness and temperature resistance. To determine the lightfastness, the samples were exposed in a Xeno test apparatus (40% r.h., 25° C., $5\times10^6$ Lux hours). The percentage loss in density measured behind blue, green or red filters, taking the original density as 1.0 and the resulting visual colour impression (colour tinge) are given in Table 1.

TABLE 1

| Sample | Colour Coupler Y | Colour Coupler M | Colour Coupler C | Reduction in colour density in % at D = 1.0 Y | Reduction in colour density in % at D = 1.0 M | Reduction in colour density in % at D = 1.0 C | Visual colour impression |
|---|---|---|---|---|---|---|---|
| 1. | V 1 | V 7 | 6 | −53 | −64 | −7 | cyan |
| 2. | V 2 | 9 | V 19 | −50 | −16 | −8 | blue |
| 3. | 40 | 9 | V 19 | −13 | −17 | −9 | neutral grey |
| 4. | 29 | 1 | V 18 | −11 | −9 | −25 | red |
| 5. | 35 | 7 | V 17 | −12 | −18 | −33 | red |
| 6. | 20 | 4 | V 15 | −11 | −57 | −15 | green |
| 7. | 43 | V 7 | V 16 | −14 | −62 | −55 | yellow |
| 8. | V 4 | V 9 | 1 | −52 | −10 | −9 | blue |
| 9. | 46 | V 6 | 19 | −12 | −60 | −6 | green |

TABLE 1-continued

| Sample | Colour Coupler Y | Colour Coupler M | Colour Coupler C | Reduction in colour density in % at D = 1.0 Y | Reduction in colour density in % at D = 1.0 M | Reduction in colour density in % at D = 1.0 C | Visual colour impression |
|---|---|---|---|---|---|---|---|
| 10. | V 5 | V 8 | V 14 | −7 | −45 | −14 | green |
| 11. | V 3 | V 7 | V 13 | −55 | −62 | −55 | neutral grey |
| 12. | 20 | 16 | V 11 | −10 | −12 | −9 | neutral grey |
| 13. | 35 | 16 | V 12 | −12 | −13 | −15 | neutral grey |
| 14. | 22 | 14 | V 15 | −8 | −11 | −14 | neutral grey |
| 15. | 40 | 16 | V 10 | −11 | −12 | −16 | neutral grey |
| 16. | 40 | 1 | 19 | −12 | −8 | −7 | neutral grey |
| 17. | 29 | 7 | 1 | −11 | −16 | −8 | neutral grey |
| 18. | 20 | 19 | 9 | −10 | −12 | −11 | neutral grey |
| 19. | 40 | 16 | 4 | −12 | −13 | −10 | neutral grey |
| 20. | 35 | 31 | 19 | −13 | −16 | −12 | neutral grey |
| 21. | 22 | 22 | 6 | −9 | −12 | −9 | neutral grey |
| 22. | 8 | 23 | 11 | −15 | −17 | −12 | neutral grey |
| 23. | 15 | 17 | 15 | −14 | −12 | −13 | neutral grey |
| 24. | 3 | 16 | 16 | −12 | −11 | −11 | neutral grey |

The following may be seen from Table 1:

Samples 1, 2 and 4 to 10 show a marked colour tinge after exposure to light due to bleaching of one or two image dyes. In samples 3 and 11 to 15, images having a neutral impression are obtained, but the absolute loss in colour density is unacceptably high, especially in sample 11. Samples 3 and 12 to 15 would be acceptable from the point of view of lightfastness, but are unsatisfactory regarding dark fading, as may be seen from Table 2. Samples 16 to 24 according to the present invention undergo only slight bleaching and maintain the neutral grey colour impression thereof.

To clarify the behaviour on exposure to light, accompanying FIG. 1 shows the deviation from neutral grey for a few samples on exposure in the Xeno test apparatus ($5\times10^6$ Lux hours). Starting from the neutral grey point at the centre of the diagram, the percentage regressions for yellow, magenta and cyan are successively entered in the diagram and added graphically. The percentage total deviation from the neutral grey point is thereby obtained for each sample.

The symbols have the following meaning:

Y—yellow
M—magenta
C—cyan

B—blue
G—green
R—red.

The inner hexagon represents a deviation of 10%. The outer hexagon represents a deviation of 40%. The points marked with numbers represent the behaviour of the corresponding samples.

Samples 4, 5, 6, 8 and 10 undergo so much bleaching on exposure to light that the observer preceives a colour tinge after a short period of exposure.

Although samples 3 and 15 remain neutral grey when bleached by exposure to light, in the dark fading test (Table 2) they show an unacceptably high non-uniformity in the regression of the two dyes which produce the most important impression on the eyes, magenta and cyan, and this leads to a colour tinge.

Sample 11 bleaches to a neutral grey and shows an acceptable regression of colour in the dark fading test (Table 2), but bleaching on exposure to light is so rapid that the colour image impression disappears within a short time.

Samples 23 and 24 according to the present invention lie within the "10%" hexagon in the Xenon test, show only a slight loss in absolute density under the conditions given and show a slow and uniform density loss of the two dyes under consideration in the dark fading test.

To determine the stability to dark fading of the dyes, a processed sample of each of the recording materials 1 to 24 (see Table 1) was stored in the dark at 40% relative humidity and at 80° to 90° C., respectively. Table 2 below shows for the "visually most important" colours, magenta and cyan, the percentage residual dye density after 8 days' storage at 90° C. (column A) and 80° C. (column B) and the colour density regression, obtained from a time series by graphic extrapolation, to 90% of the initial density (D=1.0) in days (d), again at 90° C. (column C) and at 80° C. (column D).

TABLE 2

| | A Residual density (%) at 90° C. | | B Residual density (%) at 80° C. | | C 90% residual density (d) at 90° C. | | D 90% residual density (d) at 80° C. | |
|---|---|---|---|---|---|---|---|---|
| Sample | M | C | M | C | M | C | M | C |
| 1 | 88 | 84 | 97 | 97 | 7.3 | 5.2 | 68.3 | 28.7 |
| 2 | 85 | 52 | 95 | 69 | 5.5 | 1.2 | 22.8 | 8.6 |
| 3 | 83 | 54 | 96 | 71 | 5.0 | 1.2 | 26.0 | 2.6 |
| 4 | 84 | 93 | 89 | 97 | 2.5 | 11.8 | 5.9 | 27.5 |
| 5 | 85 | 61 | 90 | 82 | 6.2 | 1.8 | 8.3 | 4.7 |
| 6 | 82 | 47 | 89 | 62 | 4.8 | 1.0 | 8.0 | 2.5 |
| 7 | 89 | 67 | 97 | 84 | 7.9 | 2.1 | 32.4 | 6.5 |
| 8 | 78 | 83 | 87 | 95 | 3.8 | 5.0 | 6.9 | 11.5 |
| 9 | 85 | 84 | 95 | 96 | 5.9 | 5.3 | 19.7 | 24.8 |
| 10 | 82 | 84 | 91 | 97 | 4.0 | 13.4 | 8.7 | 28.8 |
| 11 | 89 | 65 | 95 | 86 | 7.1 | 1.9 | 20.9 | 6.5 |
| 12 | 88 | 49 | 94 | 65 | 7.0 | 1.1 | 18.2 | 2.5 |
| 13 | 87 | 34 | 94 | 48 | 6.8 | 0.8 | 11.6 | 1.2 |
| 14 | 91 | 45 | 95 | 61 | 11.6 | 1.0 | 23.4 | 2.4 |
| 15 | 89 | 33 | 95 | 45 | 8.1 | 0.7 | 20.0 | 1.0 |
| 16 | 89 | 84 | 94 | 96 | 7.6 | 5.1 | 5.3 | 22.7 |
| 17 | 86 | 81 | 92 | 93 | 6.4 | 4.2 | 2.7 | 11.9 |
| 18 | 87 | 86 | 92 | 97 | 4.3 | 6.2 | 11.3 | 28.0 |
| 19 | 87 | 82 | 97 | 96 | 7.2 | 4.3 | 26.8 | 23.0 |
| 20 | 84 | 83 | 93 | 96 | 5.8 | 5.0 | 18.1 | 21.8 |
| 21 | 89 | 86 | 95 | 97 | 7.4 | 6.0 | 22.5 | 27.5 |
| 22 | 87 | 87 | 94 | 97 | 7.0 | 6.8 | 21.6 | 27.7 |
| 23 | 85 | 82 | 95 | 96 | 7.2 | 4.8 | 20.8 | 21.2 |
| 24 | 87 | 80 | 92 | 95 | 6.5 | 4.1 | 10.8 | 17.9 |

For the average eye, the colour brightness of the image does not appear diminished up to a uniformly and simultaneoulsy produced residual value of 90% of the original density of the "visually most important" colours, magenta and cyan, which means that when the colours bleach uniformly, this bleaching is not noticeable to the observer.

The problem arises when the various colours fade to differing extents. It is generally recognised as a guideline that a difference in colour density between different colours of more than 8% against neutral grey is easily recognised even by the lay-man as a no longer tolerable colour tinge.

It is therefore important that, apart from demanding a minimum loss in colour density, the dark fading should take place in a balanced manner for all three colours, or at least for the "visually most important" colours, magenta and cyan.

For commercial materials, the durability in the sense of acceptable colour balance is given as about 10 years (SPSE Symposium, Ottawa, 29.8. to 1.9.1982)

The durability (dark storage) of colour photographic recording materials at 25° C. may be calculated according to Arrhenius by extrapolation from the values given in Table 2 in combination with other values obtained at different temperatures and for different lengths of time (Bard et al, Kodak JAPE 6 (1980), pages 42 to 45). For reflection-viewed materials containing the coupler combinations according to the present invention, the durability under conditions of dark storage determined by extrapolation is found to be about 55 years.

We claim:

1. A color photographic recording material containing a light-reflecting layer support and, arranged thereon, at least a red-sensitive silver halide emulsion layer having associated to it a 2-acylaminophenol compound as cyan coupler, a green-sensitive silver halide emulsion layer having associated to it a pyrazolone compound as magenta coupler, and a blue-sensitive silver halide emulsion layer having associated to it an open-chain ketomethylene compound as yellow coupler, wherein the improvement comprises the couplers are selected so that the cyan coupler is a coupler corresponding to the following general formula (I):

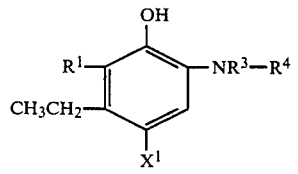

(I)

wherein $R^1$ represents halogen;

$R^3$ represents H or alkyl having up to 5 carbon atoms;

$R^4$ represents acyl; and $X^1$ represents H or a group releaseable in the process of colour coupling;

the magenta coupler is a 3-anilinopyrazolone coupler and the yellow coupler is a 2-equivalent yellow coupler derived from pivaloyl acetanilide.

2. Recording material as claimed in claim 1, wherein the cyan coupler corresponds to the following general formula (II):

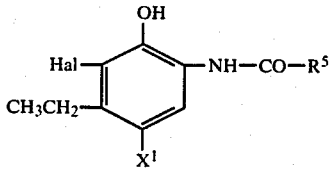

(II)

wherein

Hal represents halogen;

$X^1$ represents H or a group releaseable in the process of colour coupling; and $R^5$ represents alkyl, aryl, alkoxyalkyl, aroxyalkyl, alkoxy or alkylamino or arylamino;

the magenta coupler corresponds to the following general formula (III);

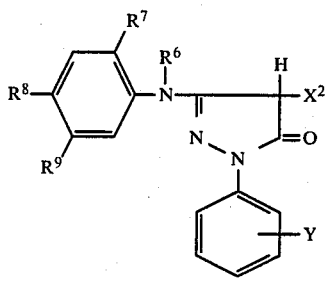

(III)

wherein $R^6$ represents H or alkyl;

$R^7$ represents H, halogen or alkoxy;

$R^8$ represents H, halogen or $R^9$;

$R^9$ represents acylamino, $—COOR^{10}$, $—CO—NR^{11}R^{12}$ or cycloimido;

$R^{10}$ represents alkyl;

$R^{11}$ represents H or $R^{12}$;

$R^{12}$ represents alkyl;

$X^2$ represents H or a group releasable in the process of colour coupling;

Y represents H or one or more identical or different substituents;

and the yellow coupler corresponds to the following general formula (IV):

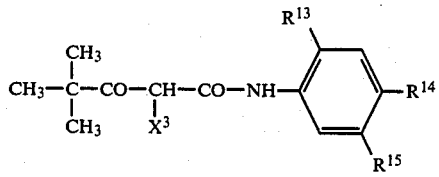

(IV)

wherein $R^{13}$ represents H, chlorine, alkoxy or dialkylamino;

$R^{14}$ represents H or alkyl;

$R^{15}$ represents $—NR^{16}—CO—R^{17}$, $—NR^{16}—SO_2—R^{17}$, $—CO—R^{18}$ or $—SO_2—NR^{16}—R^{17}$;

$R^{16}$ represents H or alkyl;

$R^{17}$ represents alkyl, aralkyl or aroxyalkyl;

$R^{18}$ represents alkyl, alkoxy or alkylamino; and $X^3$ represents a group attached via an oxygen atom or a nitrogen atom which is releasable in the process of colour coupling.

3. Recording material as claimed in claim 1, wherein the cyan coupler corresponds to the following general formula (V)

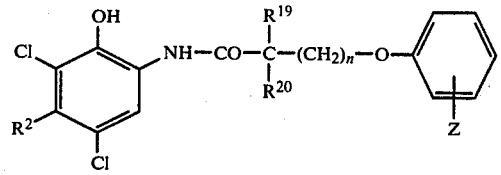

(V)

wherein $R^2$ represents ethyl;

$R^{19}$, $R^{20}$ represents H or alkyl;

n represents 0 or an integer of from 1 to 3; and

Z represents one or more alkyl groups having from 1 to 16 carbon atoms, the sum of the carbon atoms in Z and $R^{20}$ amounting to at least 8;

the magenta coupler corresponds to the following general formula (VI):

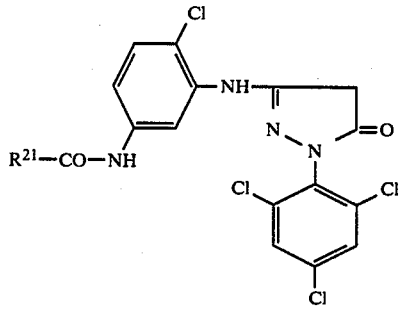

(VI)

wherein $R^{21}$ represents an alkyl or alkoxy group conferring diffusion resistance;

and the yellow coupler corresponds to the following general formula (VII):

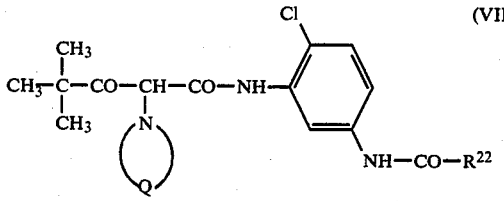

(VII)

wherein $R^{22}$ represents an alkyl or aroxyalkyl group conferring diffusion resistance; and Q represents a group for completing a substituted or unsubstituted imidazole, pyrazole, triazole, oxazole, thiazole or thiadiazole ring.

4. A process of producing color photographic images of improved dark-fading stability by chromogenic development of a color photographic recording material containing a light-reflecting layer support and, arranged thereon, at least a red-sensitive silver halide emulsion layer having associated to it a 2-acylaminophenol compound as cyan coupler, a green-sensitive silver halide emulsion layer having associated to it a pyrazolone compound as magenta coupler, and a blue-sensitive silver halide emulsion layer having associated to it an open-chain ketomethylene compound as yellow coupler, wherein the improvement comprises the couplers are selected so that the cyan coupler is a coupler corresponding to the following general formula:

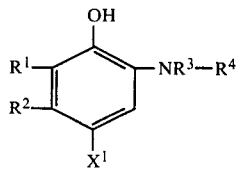

(I)

wherein $R^1$ represents halogen;

$R^2$ represents alkyl having at least 2 carbon atoms;

$R^3$ represents H or alkyl having up to 5 carbon atoms;

$R^4$ represents acyl; and $X^1$ represents H or a group releaseable in the process of color coupling;

the magenta coupler is a 3-anilinopyrazolone coupler and the yellow coupler is a 2-equivalent yellow coupler derived from pivaloyl acetanilide.

5. The process as claimed in claim 4, wherein the cyan coupler corresponds to the following general formula (III):

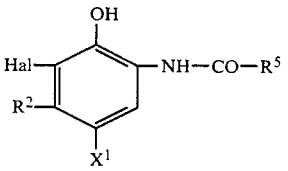

(II)

wherein

Hal represents halogen;

$X^1$ represents H or a group releaseable in the process of colour coupling;

$R^2$ represents alkyl having from 2 to 20 carbon atoms; and $R^5$ represents alkyl, aryl, alkoxyalkyl, aroxyalkyl, alkoxy or alkylamino or arylamino;

the magenta coupler corresponds to the following general formula (III):

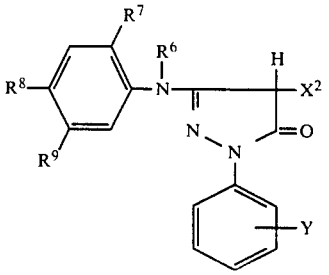

(III)

wherein $R^6$ represents H or alkyl;

$R^7$ represents H, halogen or alkoxy;

$R^8$ represents H, halogen or $R^9$;

$R^9$ represents acylamino, $—COOR^{10}$, $—CO—NR^{11}R^{12}$ or cycloimido;

$R^{10}$ represents alkyl;

$R^{11}$ represents H or $R^{12}$;

$R^{12}$ represents alkyl;

$X^2$ represents H or a group releasable in the process of colour coupling;

Y represents H or one or more identical or different substituents;

and the yellow coupler corresponds to the following general formula (IV):

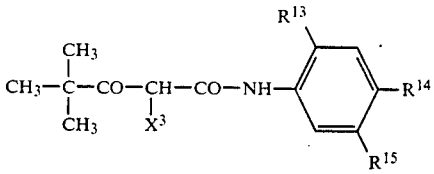

wherein $R^{13}$ represents H, chlorine, alkoxy or dialkylamino;

$R^{14}$ represents H or alkyl;

$R^{15}$ represents $—NR^{16}—CO—R^{17}$, $—NR^{16}—SO_2—R^{17}$, $—CO—R^{18}$ or $—SO_2—NR^{16}—R^{17}$;

$R^{16}$ represents H or alkyl;

$R^{17}$ represents alkyl, aralkyl or aroxyalkyl;

$R^{18}$ represents alkyl, alkoxy or alkylamino; and $X^3$ represents a group attached via an oxygen atom or a nitrogen atom which is releasable in the process of colour coupling.

* * * * *